US008556267B2

(12) United States Patent
Gobush

(10) Patent No.: US 8,556,267 B2
(45) Date of Patent: Oct. 15, 2013

(54) LAUNCH MONITOR

(75) Inventor: William Gobush, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 2723 days.

(21) Appl. No.: 10/898,584

(22) Filed: Jul. 26, 2004

(65) Prior Publication Data

US 2005/0272516 A1 Dec. 8, 2005

Related U.S. Application Data

(63) Continuation-in-part of application No. 10/861,443, filed on Jun. 7, 2004, now Pat. No. 7,395,696.

(51) Int. Cl.
*A63F 7/20* (2006.01)
*A63F 13/00* (2006.01)
*A63B 57/00* (2006.01)

(52) U.S. Cl.
USPC ..... 273/317.2; 463/1; 473/131

(58) Field of Classification Search
USPC ..... 473/353, 198, 570, 131; 702/153, 151, 702/149; 273/317.2; 463/1
See application file for complete search history.

(56) References Cited

U.S. PATENT DOCUMENTS

| | | | | |
|---|---|---|---|---|
| 1,876,657 | A | 5/1932 | Fox | 473/223 |
| 2,472,893 | A | 6/1949 | Lyle | 63/15.3 |
| 2,610,504 | A | 4/1952 | Nigh | 73/12.08 |
| 2,660,880 | A | 12/1953 | Vivian | 73/12.13 |
| 2,755,658 | A | 7/1956 | Brown | 73/12.13 |
| 2,783,999 | A | 3/1957 | Simjian | 473/156 |
| 2,825,569 | A | 3/1958 | Alvarez | 473/221 |
| 2,933,681 | A | 4/1960 | Crain | 324/180 |
| 3,016,812 | A | 1/1962 | Chatlain | 396/171 |
| 3,091,466 | A | 5/1963 | Speiser | 473/155 |
| 3,160,011 | A | 12/1964 | Ogden | 473/155 |
| 3,173,348 | A | 3/1965 | Betinis | 396/263 |
| 3,182,508 | A | 5/1965 | Varju | 473/223 |

(Continued)

OTHER PUBLICATIONS

U.S. Appl. No. 10/759,080, filed Jan. 20, 2004 entitled "One Camera Club Monitor".

(Continued)

*Primary Examiner* — Arthur O. Hall
*Assistant Examiner* — Jeffrey Wong
(74) *Attorney, Agent, or Firm* — Smith, Gambrell & Russell, LLP

(57) ABSTRACT

A launch monitor that includes substantially all of its functional components on or within a housing is disclosed. In one embodiment, the launch monitor is capable of being transported and used in any desired location. One or more camera's, flashes, and triggers may be used to acquire images of a golf club and golf ball. The launch monitor is preferably capable of receiving and transmitting data over a wireless network. Acquired images and other data may be analyzed by a processor, and then displayed using an LED, LCD or other type of display or printer. The launch monitor may "recognize" a plurality of golf clubs and golf balls based on an optical fingerprint. The optical fingerprints, which are preferably stored in a memory, allow the launch monitor to identify a golf club and/or ball substantially soon after they are placed in the field of view of the monitor Optical fingerprinting enables automatic record keeping, and storing performance data and equipment used simultaneously. This feature eliminates tedious record keeping, eliminates data entry errors, and enables rapid equipment optimization.

37 Claims, 21 Drawing Sheets

(56) References Cited

U.S. PATENT DOCUMENTS

| | | | | |
|---|---|---|---|---|
| 3,270,564 | A | 9/1966 | Evans | 73/865.4 |
| 3,353,282 | A | 11/1967 | Sneed | 434/257 |
| 3,359,005 | A | 12/1967 | Cameron | 473/141 |
| 3,364,751 | A | 1/1968 | Cornell et al. | 473/154 |
| 3,408,750 | A | 11/1968 | McCollough et al. | 434/252 |
| 3,429,571 | A | 2/1969 | Abel, Jr. | 473/212 |
| 3,469,905 | A | 9/1969 | Baldwin et al. | 352/39 |
| 3,508,440 | A | 4/1970 | Murphy | 473/155 |
| 3,513,707 | A | 5/1970 | Russell | 473/152 |
| 3,566,668 | A | 3/1971 | Browning | 73/12.13 |
| 3,589,732 | A | 6/1971 | Russell et al. | 473/156 |
| 3,598,976 | A | 8/1971 | Russell et al. | 473/156 |
| 3,630,601 | A | 12/1971 | Lehovec | 356/256 |
| 3,633,007 | A | 1/1972 | Sanders | 473/199 |
| 3,633,008 | A | 1/1972 | Sanders | 473/199 |
| 3,671,724 | A | 6/1972 | Sanders | 473/155 |
| 3,717,875 | A | 2/1973 | Arciprete et al. | 347/73 |
| 3,759,528 | A | 9/1973 | Christophers et al. | 473/152 |
| 3,788,647 | A | 1/1974 | Evans | 473/223 |
| 3,792,863 | A | 2/1974 | Evans | 473/223 |
| 3,793,481 | A | 2/1974 | Ripley et al. | 348/139 |
| 3,804,518 | A | 4/1974 | Meyr | 356/28 |
| 3,806,131 | A | 4/1974 | Evans | 473/223 |
| 3,818,341 | A | 6/1974 | Burdick | 327/552 |
| 3,820,133 | A | 6/1974 | Adorney et al. | 396/1 |
| 3,918,073 | A | 11/1975 | Henderson et al. | 396/335 |
| 3,935,669 | A | 2/1976 | Potrzuski et al. | 446/485 |
| 3,945,646 | A | 3/1976 | Hammond | 473/223 |
| 3,992,012 | A | 11/1976 | Campbell | 473/225 |
| 4,005,261 | A | 1/1977 | Sato et al. | 348/579 |
| 4,025,718 | A | 5/1977 | Paretti | 358/448 |
| 4,033,318 | A | 7/1977 | O'Grady | 124/7 |
| 4,041,293 | A | 8/1977 | Kihlberg | 702/143 |
| 4,063,259 | A | 12/1977 | Lynch et al. | 396/335 |
| 4,088,324 | A | 5/1978 | Farmer | 473/223 |
| 4,136,387 | A | 1/1979 | Sullivan et al. | 473/200 |
| 4,136,687 | A | 1/1979 | Dabroski | 602/8 |
| 4,137,566 | A | 1/1979 | Haas et al. | 473/209 |
| 4,138,118 | A | 2/1979 | Budney | 473/202 |
| 4,148,096 | A | 4/1979 | Haas et al. | 362/252 |
| 4,155,555 | A | 5/1979 | Fink | 473/221 |
| 4,158,853 | A | 6/1979 | Sullivan et al. | 348/157 |
| 4,160,942 | A | 7/1979 | Lynch et al. | 359/443 |
| 4,223,891 | A | 9/1980 | Van Gaasbeek et al. | 473/225 |
| 4,239,227 | A | 12/1980 | Davis | 473/220 |
| 4,306,722 | A | 12/1981 | Rusnak | 473/221 |
| 4,306,723 | A | 12/1981 | Rusnak | 473/225 |
| 4,327,918 | A | 5/1982 | Foster | 360/40 |
| 4,342,054 | A | 7/1982 | Terui et al. | 360/40 |
| 4,360,199 | A | 11/1982 | Jackson | 473/132 |
| 4,375,887 | A | 3/1983 | Lynch et al. | 473/409 |
| 4,461,477 | A | 7/1984 | Stewart | 473/453 |
| 4,477,079 | A | 10/1984 | White | 473/221 |
| 4,570,607 | A | 2/1986 | Stokes | 124/63 |
| 4,580,786 | A | 4/1986 | Shipley | 473/229 |
| 4,630,829 | A | 12/1986 | White | 473/221 |
| 4,640,120 | A | 2/1987 | Garritano et al. | 73/12.13 |
| 4,684,133 | A | 8/1987 | Maroth | 473/233 |
| 4,695,888 | A | 9/1987 | Peterson | 348/221.1 |
| 4,695,891 | A | 9/1987 | Peterson | 348/368 |
| 4,711,754 | A | 12/1987 | Bednar | 376/245 |
| 4,713,686 | A | 12/1987 | Ozaki et al. | 348/157 |
| 4,759,219 | A | 7/1988 | Cobb et al. | 73/493 |
| 4,767,121 | A | 8/1988 | Tonner | 473/141 |
| 4,822,042 | A | 4/1989 | Landsman | 473/463 |
| 4,830,377 | A | 5/1989 | Kobayashi | 473/224 |
| 4,834,376 | A | 5/1989 | Steinberg | 473/457 |
| 4,844,469 | A | 7/1989 | Yasuda et al. | 473/225 |
| 4,858,934 | A | 8/1989 | Ladick et al. | 473/220 |
| 4,861,034 | A | 8/1989 | Lee | 473/202 |
| 4,870,868 | A | 10/1989 | Gastgeb et al. | 73/649 |
| 4,893,182 | A | 1/1990 | Gautraud et al. | 348/579 |
| 4,898,388 | A | 2/1990 | Beard, III et al. | 473/192 |
| 4,898,389 | A | 2/1990 | Plutt | 473/223 |
| 4,930,787 | A | 6/1990 | Nobles, Jr. | 473/223 |
| 4,940,236 | A | 7/1990 | Allen | 473/223 |
| 4,958,836 | A | 9/1990 | Onozuka et al. | 473/141 |
| 4,967,596 | A | 11/1990 | Rilling et al. | 73/492 |
| 4,991,850 | A | 2/1991 | Wilhlem | 473/233 |
| 4,991,851 | A | 2/1991 | Melesio | 473/200 |
| 5,031,909 | A | 7/1991 | Pecker | 473/463 |
| 5,054,785 | A | 10/1991 | Gobush et al. | 473/199 |
| 5,056,791 | A | 10/1991 | Poillon et al. | 473/156 |
| 5,082,283 | A | 1/1992 | Conley et al. | 473/234 |
| 5,101,268 | A | 3/1992 | Ohba | 348/43 |
| 5,111,410 | A | 5/1992 | Nakayama et al. | 434/258 |
| 5,118,102 | A | 6/1992 | Bahill et al. | 473/564 |
| 5,131,660 | A | 7/1992 | Marocco | 473/220 |
| 5,179,441 | A | 1/1993 | Anderson et al. | 348/43 |
| 5,184,826 | A | 2/1993 | Hall, Jr. | 473/224 |
| 5,209,483 | A | 5/1993 | Gedney et al. | 473/223 |
| 5,210,602 | A | 5/1993 | Mintzer | 358/518 |
| 5,221,082 | A | 6/1993 | Curshod | 473/199 |
| 5,221,088 | A | 6/1993 | McTeigue et al. | 473/201 |
| 5,226,660 | A | 7/1993 | Curchod | 473/155 |
| 5,228,697 | A | 7/1993 | Gulick et al. | 473/200 |
| 5,233,544 | A | 8/1993 | Kobayashi | 702/141 |
| 5,246,232 | A | 9/1993 | Eccher et al. | 473/199 |
| 5,247,835 | A | 9/1993 | Howell | 73/12.01 |
| 5,259,617 | A | 11/1993 | Soong | 473/205 |
| 5,269,177 | A | 12/1993 | Miggins et al. | 73/65.03 |
| 5,297,796 | A | 3/1994 | Peterson | 473/266 |
| 5,303,925 | A | 4/1994 | Rawson | 473/233 |
| 5,309,753 | A | 5/1994 | Johnson | 73/65.03 |
| 5,322,289 | A | 6/1994 | Abrams et al. | 473/202 |
| 5,332,225 | A | 7/1994 | Ura | 473/223 |
| 5,342,051 | A | 8/1994 | Rankin et al. | 473/199 |
| 5,342,054 | A | 8/1994 | Chang et al. | 473/156 |
| 5,375,844 | A | 12/1994 | Waud | 473/268 |
| 5,377,541 | A | 1/1995 | Patten | 73/379.02 |
| 5,395,116 | A | 3/1995 | Blaakman | 473/224 |
| 5,413,345 | A | 5/1995 | Nauck | 473/156 |
| 5,419,563 | A | 5/1995 | Abrams et al. | 473/202 |
| 5,435,561 | A | 7/1995 | Conley | 473/224 |
| 5,437,457 | A | 8/1995 | Curchod | 473/224 |
| 5,441,256 | A | 8/1995 | Hackman | 473/409 |
| 5,441,269 | A | 8/1995 | Henwood | 473/220 |
| 5,447,311 | A | 9/1995 | Viollaz et al. | 473/342 |
| 5,464,208 | A | 11/1995 | Pierce | 473/451 |
| 5,469,627 | A | 11/1995 | Denny et al. | 33/508 |
| 5,471,383 | A * | 11/1995 | Gobush et al. | 700/91 |
| 5,472,205 | A | 12/1995 | Bouton | 473/222 |
| 5,474,298 | A | 12/1995 | Lindsay | 473/222 |
| 5,482,283 | A | 1/1996 | Wall | 473/220 |
| 5,486,001 | A | 1/1996 | Baker | 473/266 |
| 5,486,002 | A | 1/1996 | Witler et al. | 473/199 |
| 5,489,099 | A | 2/1996 | Rankin et al. | 473/199 |
| 5,492,329 | A | 2/1996 | Kronin | 473/220 |
| 5,501,463 | A | 3/1996 | Gobush et al. | 273/184 R |
| 5,507,485 | A * | 4/1996 | Fisher | 473/407 |
| 5,575,719 | A | 11/1996 | Gobush et al. | 473/223 |
| 5,582,552 | A | 12/1996 | Hofmeister | 473/242 |
| 5,586,940 | A | 12/1996 | Dosch et al. | 473/140 |
| 5,589,628 | A | 12/1996 | Braly | 73/12.02 |
| 5,609,534 | A | 3/1997 | Gebhardt et al. | 473/409 |
| 5,616,832 | A | 4/1997 | Nauck | 73/65.03 |
| 5,623,459 | A | 4/1997 | Iwamura et al. | 369/126 |
| 5,625,577 | A | 4/1997 | Kunii et al. | 703/2 |
| 5,634,855 | A | 6/1997 | King | 473/221 |
| 5,638,300 | A | 6/1997 | Johnson | 702/153 |
| 5,645,494 | A | 7/1997 | Dionne et al. | 473/278 |
| 5,672,809 | A | 9/1997 | Brandt | 73/12.01 |
| 5,682,230 | A | 10/1997 | Anfinsen et al. | 356/28 |
| 5,688,183 | A | 11/1997 | Sabatino et al. | 473/212 |
| 5,694,340 | A | 12/1997 | Kim | 702/141 |
| 5,697,791 | A | 12/1997 | Nashner et al. | 434/247 |
| 5,700,204 | A | 12/1997 | Teder | 473/199 |
| 5,707,298 | A | 1/1998 | Chovanes | 473/223 |
| 5,709,610 | A | 1/1998 | Ognjanovic | 473/223 |
| 5,779,241 | A | 7/1998 | D'Costa et al. | 273/371 |
| 5,779,555 | A | 7/1998 | Nomura et al. | 473/223 |
| 5,792,000 | A | 8/1998 | Weber et al. | 473/223 |
| 5,792,001 | A | 8/1998 | Henwood | 473/224 |
| 5,803,823 | A | 9/1998 | Gobush et al. | 473/223 |

(56) References Cited

U.S. PATENT DOCUMENTS

| | | | | |
|---|---|---|---|---|
| 5,803,826 | A | 9/1998 | Perrine | 473/278 |
| 5,823,786 | A | 10/1998 | Easterbrook | 434/247 |
| 5,863,255 | A | 1/1999 | Mack | 473/152 |
| 5,879,246 | A | 3/1999 | Gebhardt et al. | 473/409 |
| 5,899,822 | A | 5/1999 | Yamagishi et al. | 473/374 |
| 5,904,484 | A | 5/1999 | Burns | 434/252 |
| 5,906,547 | A | 5/1999 | Tynan | 473/199 |
| 5,916,040 | A | 6/1999 | Umazume | 473/317 |
| 6,034,723 | A | 3/2000 | Fujimori | 348/207.99 |
| 6,042,483 | A | 3/2000 | Katayama | 473/199 |
| 6,042,492 | A | 3/2000 | Baum | 473/453 |
| 6,079,612 | A | 6/2000 | Tung | 228/219 |
| 6,148,271 | A * | 11/2000 | Marinelli | 702/141 |
| 6,185,850 | B1 | 2/2001 | Erkel | 40/657 |
| 6,186,002 | B1 | 2/2001 | Lieberman et al. | 73/432.1 |
| 6,186,910 | B1 | 2/2001 | Kobayashi | 473/422 |
| 6,195,090 | B1 | 2/2001 | Riggins, III | 725/139 |
| 6,213,888 | B1 | 4/2001 | Kawaguchi et al. | 473/223 |
| 6,224,499 | B1 | 5/2001 | Ogg | 473/383 |
| 6,231,453 | B1 | 5/2001 | Jebe | 473/233 |
| 6,241,622 | B1 | 6/2001 | Gobush et al. | 473/199 |
| 6,286,364 | B1 | 9/2001 | Aoyama et al. | 73/65.03 |
| 6,292,130 | B1 | 9/2001 | Cavallaro et al. | 342/104 |
| 6,293,802 | B1 | 9/2001 | Ahlgren | 434/252 |
| 6,320,173 | B1 | 11/2001 | Vock et al. | 250/206.1 |
| 6,328,660 | B1 | 12/2001 | Bunn, III | 473/257 |
| 6,366,205 | B1 * | 4/2002 | Sutphen | 340/568.6 |
| 6,390,934 | B1 | 5/2002 | Winfield et al. | 473/351 |
| 6,398,670 | B1 | 6/2002 | Engelhardt et al. | 473/407 |
| 6,410,990 | B2 | 6/2002 | Taylor et al. | 257/786 |
| 6,411,211 | B1 * | 6/2002 | Boley et al. | 340/568.6 |
| 6,431,990 | B1 | 8/2002 | Manwaring | 473/199 |
| 6,441,775 | B1 | 8/2002 | Fujikawa et al. | 340/669 |
| 6,465,986 | B1 | 10/2002 | Haba | 320/116 |
| 6,488,591 | B1 | 12/2002 | Gobush et al. | 473/199 |
| 6,500,073 | B1 | 12/2002 | Pelletier et al. | 473/199 |
| 6,506,124 | B1 | 1/2003 | Manwaring et al. | 473/198 |
| 6,514,081 | B1 | 2/2003 | Mengoli | 434/252 |
| 6,519,545 | B1 | 2/2003 | Amano | 702/127 |
| 6,523,964 | B2 | 2/2003 | Schofield et al. | 359/601 |
| 6,533,674 | B1 | 3/2003 | Gobush | 473/199 |
| 6,561,917 | B2 | 5/2003 | Manwaring | 473/151 |
| 6,567,536 | B2 | 5/2003 | McNitt et al. | 382/107 |
| 6,577,238 | B1 * | 6/2003 | Whitesmith et al. | 340/572.1 |
| 6,579,190 | B2 | 6/2003 | Yamamoto | 473/141 |
| 6,592,465 | B2 | 7/2003 | Lutz et al. | 473/198 |
| 6,602,144 | B2 | 8/2003 | Manwaring et al. | 473/198 |
| 6,607,123 | B1 | 8/2003 | Jollifee et al. | 235/375 |
| 6,616,543 | B1 | 9/2003 | Gobush et al. | 473/199 |
| 6,638,175 | B2 | 10/2003 | Lee et al. | 473/223 |
| 6,758,759 | B2 | 7/2004 | Gobush et al. | 473/131 |
| 6,764,412 | B2 | 7/2004 | Gobush et al. | 473/199 |
| 6,781,621 | B1 | 8/2004 | Gobush et al. | 348/157 |
| 6,782,118 | B2 | 8/2004 | Verga | 382/106 |
| 6,802,617 | B2 | 10/2004 | Schofield et al. | 359/601 |
| 6,908,404 | B1 * | 6/2005 | Gard | 473/407 |
| 6,920,614 | B1 | 7/2005 | Schindler et al. | 715/726 |
| 6,956,614 | B1 | 10/2005 | Quintana et al. | 348/373 |
| 6,974,395 | B1 | 12/2005 | Rioux et al. | 473/409 |
| 6,982,132 | B1 | 1/2006 | Goldner et al. | 429/162 |
| 7,063,256 | B2 | 6/2006 | Anderson et al. | 235/385 |
| 7,184,569 | B2 | 2/2007 | Lawandy et al. | 382/100 |
| 7,209,576 | B2 | 4/2007 | Rankin | 382/107 |
| 7,283,647 | B2 | 10/2007 | McNitt | 382/107 |
| 7,311,611 | B2 | 12/2007 | Cameron et al. | 473/221 |
| 2001/0029207 | A1 | 10/2001 | Cameron et al. | |
| 2002/0022531 | A1 | 2/2002 | Katayama | |
| 2002/0030527 | A1 | 3/2002 | Hung et al. | |
| 2002/0043757 | A1 | 4/2002 | d'Agrella et al. | |
| 2002/0064764 | A1 | 5/2002 | Fishman et al. | |
| 2002/0077164 | A1 | 6/2002 | Sundstrom | |
| 2002/0085213 | A1 | 7/2002 | Yamamoto et al. | |
| 2002/0103035 | A1 | 8/2002 | Lindsay | |
| 2002/0155896 | A1 | 10/2002 | Gobush et al. | |
| 2002/0173364 | A1 | 11/2002 | Boscha | |
| 2002/0173367 | A1 | 11/2002 | Gobush et al. | |
| 2002/0177490 | A1 * | 11/2002 | Yong et al. | 473/353 |
| 2003/0062080 | A1 | 4/2003 | Satoh et al. | |
| 2003/0103684 | A1 | 6/2003 | Gobush et al. | |
| 2003/0109322 | A1 | 6/2003 | Funk et al. | |
| 2003/0130054 | A1 | 7/2003 | Bissonnette et al. | |
| 2004/0030527 | A1 * | 2/2004 | Rankin | 702/153 |
| 2004/0032970 | A1 | 2/2004 | Kiraly | |
| 2004/0142772 | A1 | 7/2004 | Asakura | |
| 2004/0162154 | A1 | 8/2004 | DeJohn | |
| 2004/0209698 | A1 * | 10/2004 | Ueda et al. | 473/150 |
| 2004/0212677 | A1 | 10/2004 | Uebbing | |
| 2004/0241630 | A1 | 12/2004 | Hutchon et al. | |
| 2004/0248662 | A1 | 12/2004 | Gobush et al. | |
| 2004/0259653 | A1 | 12/2004 | Gobush et al. | |
| 2005/0063595 | A1 | 3/2005 | Bissonnette et al. | |
| 2005/0085309 | A1 | 4/2005 | McGann et al. | |
| 2005/0153785 | A1 | 7/2005 | Sun | |
| 2005/0272512 | A1 | 12/2005 | Bissonnette et al. | |
| 2005/0282645 | A1 | 12/2005 | Bissonnette et al. | |
| 2007/0089066 | A1 | 4/2007 | Chaudhri et al. | |
| 2007/0111767 | A1 | 5/2007 | Brown et al. | |

OTHER PUBLICATIONS

U.S. Appl. No. 10/667,479, filed Sep. 23, 2003 entitled "Golf Club and Ball Performance Monitor Having an Ultrasonic Trigger".

U.S. Appl. No. 10/667,478, filed Sep. 23, 2003 entitled "Golf Club and Ball Performance Monitor With Automatic Pattern Recognition".

U.S. Appl. No. 10/656,882, filed Sep. 8, 2003 entitled "Multishutter Club-Ball Analyzer".

Tiger Woods PGA Tour 2001. "GameSpot." Feb. 26, 2001. http://www.gamespot.com/ps2/sports/tigerwoodspgatour2001/idex.html.

"EA Sports ships Tiger Woods PS2."GameSpot. Feb. 26, 2001. http://www.gamespot.com/ps2/sports/tigerwoodsptatour2001/news.html?sid=2690628&om_act=covert&om_clk=newsfeatures&tag=newsfeatures;title;3>.

SearchUnifiedCommunications.com, Data Transfer Rate. pp. 1-3. Retrieved from http://searchunifiedcommunications.techtarget.com/sDefinition/0,,sid186_gci213492,00.html on Mar. 3, 2008.

* cited by examiner

| PHYSICAL PARAMETERS | |
|---|---|
| FPGA CLOCK (hz) | 1.00E+07 |
| DIST T1 TO T2 (in) | 0.875 |
| DIST T1 TO S1 (in) | 4 |
| DIST T1 TO S2 (in) | 7.5 |
| DIST T1 TO S3 (in) | 11.0 |
| DIST T1 TO S4 (in) | 13 |

T1 = FIRST LASER POSITION.
T2 = SECOND LASER POSITION.
S1 = DESIRED POSITION OF CLUB FOR FIRST STROBE ILLUMINATION.
S2 = DESIRED POSITION OF CLUB FOR SECOND STROBE ILLUMINATION.
S3 = DESIRED POSITION OF BALL FOR THIRD STROBE ILLUMINATION.
S4 = DESIRED POSITION OF BALL FOR FOURTH STROBE ILLUMINATION.

| LOOKUP TABLE ROW | TRIGGER COUNT COUNT | CLUB CAMERA OPEN COUNT | FIRST STROBE COUNT | SECOND STROBE COUNT | CLUB CAMERA CLOSE COUNT | BALL CAMERA OPEN COUNT | THIRD STROBE COUNT | FOURTH STROBE COUNT | BALL CAMERA CLOSE COUNT |
|---|---|---|---|---|---|---|---|---|---|
| 0 | 16300 | 74416 | 74516 | 139717 | 139917 | 195049 | 195149 | 220494 | 220694 |
| 1 | 14970 | 68333 | 68433 | 128311 | 128511 | 179293 | 179393 | 202669 | 202869 |
| 2 | 13748 | 62746 | 62846 | 117837 | 118037 | 164824 | 164924 | 186300 | 186500 |
| 3 | 12625 | 57616 | 57716 | 108218 | 108418 | 151535 | 151635 | 171267 | 171467 |
| 4 | 11595 | 52905 | 53005 | 99384 | 99584 | 139332 | 139432 | 157461 | 157661 |
| 5 | 10648 | 48578 | 48678 | 91271 | 91471 | 128125 | 128225 | 144782 | 144982 |
| 6 | 9779 | 44604 | 44704 | 83820 | 84020 | 117832 | 117932 | 133138 | 133338 |
| 7 | 8981 | 40955 | 41055 | 76977 | 77177 | 108380 | 108480 | 122444 | 122644 |
| 8 | 8248 | 37603 | 37703 | 70694 | 70894 | 99699 | 99799 | 112624 | 112824 |
| 9 | 7574 | 34525 | 34625 | 64923 | 65123 | 91727 | 91827 | 103605 | 103805 |
| 10 | 6956 | 31699 | 31799 | 59623 | 59823 | 84406 | 84506 | 95322 | 95522 |
| 11 | 6388 | 29103 | 29203 | 54756 | 54956 | 77683 | 77783 | 87716 | 87916 |
| 12 | 5867 | 26719 | 26819 | 50286 | 50486 | 71508 | 71608 | 80730 | 80930 |
| 13 | 5388 | 24530 | 24630 | 46181 | 46381 | 65837 | 65937 | 74315 | 74515 |
| 14 | 4948 | 22519 | 22619 | 42411 | 42611 | 60630 | 60730 | 68423 | 68623 |
| 15 | 4544 | 20673 | 20773 | 38949 | 39149 | 55847 | 55947 | 63013 | 63213 |
| 16 | 4173 | 18977 | 19077 | 35769 | 35969 | 51455 | 51555 | 58044 | 58244 |
| 17 | 3832 | 17420 | 17520 | 32849 | 33049 | 47421 | 47521 | 53480 | 53680 |
| 18 | 3520 | 15990 | 16090 | 30168 | 30368 | 43717 | 43817 | 49290 | 49490 |
| 19 | 3232 | 14676 | 14776 | 27705 | 27905 | 40315 | 40415 | 45441 | 45641 |

FIG. 2

2. VIDEO SUBSYSTEM INTERCONNECTIONS

3. CAMERA INTERCONNECTIONS

5. COMPUTER NETWORKING INTERCONNECTION (CBM ONLY)

| | BALL SPEED (mph) | SIDE ANGLE (deg) | BACK SPIN (rpm) | SIDE SPIN (rpm) | RIFLE SPIN (rpm) | SPIN MAGNITUDE (rpm) |
|---|---|---|---|---|---|---|
| | 160.9 | -1.9 | 3019 | 90 | -194 | 3027 |
| | 161.3 | -1.9 | 3019 | 6 | -163 | 3023 |
| | 160.2 | -1.8 | 3008 | 224 | -96 | 3018 |
| | 161.0 | -1.8 | 3031 | 43 | -152 | 3035 |
| | 160.5 | -1.8 | 3011 | 161 | -158 | 3019 |
| | 160.9 | -1.8 | 3017 | 97 | -187 | 3024 |
| | 161.3 | -1.9 | 3018 | 9 | -185 | 3023 |
| | 160.8 | -1.8 | 3015 | 113 | -203 | 3024 |
| | 161.0 | -1.8 | 3012 | 56 | -173 | 3018 |
| | 161.2 | -1.8 | 3022 | 43 | -180 | 3027 |
| | 161.0 | -1.8 | 3016 | 107 | -224 | 3026 |
| | 161.0 | -1.8 | 3032 | 34 | -164 | 3036 |
| | 161.0 | -1.9 | 3023 | 123 | -218 | 3034 |
| | 160.6 | -1.9 | 2996 | 168 | -189 | 3007 |
| | 161.2 | -1.8 | 3009 | 41 | -110 | 3011 |
| | 161.3 | -1.8 | 3016 | 54 | -133 | 3020 |
| | 160.9 | -1.9 | 3020 | 90 | -116 | 3023 |
| | 161.3 | -1.8 | 3017 | 41 | -166 | 3022 |
| | 161.4 | -1.7 | 3008 | 61 | -161 | 3013 |
| | 161.0 | -1.8 | 2998 | 87 | -153 | 3003 |
| | 161.0 | -1.8 | 3025 | 94 | -124 | 3029 |
| | 161.1 | -1.8 | 3005 | 64 | -105 | 3007 |
| | 161.1 | -1.8 | 3015 | 76 | -146 | 3019 |
| | 160.8 | -1.8 | 3008 | 144 | -114 | 3013 |
| | 161.1 | -1.8 | 3002 | 97 | -162 | 3008 |
| | 160.2 | -1.9 | 2989 | 266 | -251 | 3012 |
| | 160.8 | -1.9 | 3018 | 147 | -200 | 3028 |
| | 160.2 | -1.9 | 2996 | 232 | -196 | 3012 |
| | 161.2 | -1.9 | 3010 | 32 | -163 | 3014 |
| | 161.2 | -1.9 | 3034 | 67 | -183 | 3040 |
| | 161.3 | -1.8 | 3036 | 17 | -134 | 3039 |
| | 161.1 | -1.9 | 3010 | 71 | -151 | 3015 |
| | 161.1 | -1.8 | 3009 | 82 | -136 | 3013 |
| | 161.1 | -1.9 | 3017 | 99 | -159 | 3023 |
| | 161.0 | -1.8 | 3016 | 103 | -101 | 3020 |
| | 161.4 | -1.8 | 3026 | 29 | -122 | 3029 |
| | 161.2 | -1.9 | 3026 | 60 | -156 | 3030 |
| | 161.1 | -1.9 | 3016 | 77 | -122 | 3020 |
| | 161.1 | -1.9 | 3019 | 70 | -148 | 3023 |
| | 160.9 | -1.9 | 3008 | 147 | -118 | 3014 |
| | 161.3 | -1.8 | 3010 | 44 | -148 | 3014 |
| | 161.0 | -1.9 | 3018 | 96 | -174 | 3024 |
| | 161.2 | -1.9 | 3023 | 59 | -148 | 3028 |
| | 161.0 | -1.9 | 3034 | 86 | -179 | 3040 |
| | 161.1 | -1.8 | 3021 | 81 | -117 | 3024 |
| | 161.0 | -1.9 | 3019 | 106 | -147 | 3025 |
| | 161.0 | -1.8 | 3033 | 133 | -146 | 3040 |
| | 160.7 | -1.7 | 2997 | 105 | -68 | 3000 |
| | 161.2 | -1.8 | 3017 | 77 | -128 | 3021 |
| | 161.8 | -1.7 | 3004 | 22 | -184 | 3009 |
| AVERAGE | 161.0 | -1.8 | 3015 | 89 | -155 | 3021 |
| STANDARD DEVIATION | 0.3 | 0.1 | 10 | 54 | 35 | 10 |

FIG. 11

| | | CLUB HEAD KINEMATICS | | | | | | | | | | |
|---|---|---|---|---|---|---|---|---|---|---|---|---|
| | | VELOCITY | ATTACK | PATH | LOFT | FACE | DROOP | FACESPIN | DROOPSPIN | LOFTSPIN | VERTIMPACT | HORZIMPACT |
| | | (mph) | (deg) | (deg) | (deg) | (deg) | (deg) | (rpm) | (rpm) | (rpm) | (in) | (in) |
| TEST 1 | AVERAGE | 98.1 | -0.8 | -1.1 | 13.2 | -1.7 | 1.8 | 386 | 79 | 82 | 0.03 | -0.08 |
| | STDEV | 0.2 | 0.1 | 0.1 | 0.2 | 0.2 | 0.1 | 10 | 3 | 18 | 0.02 | 0.02 |
| | | | | | | | | | | | | |
| TEST 2 | AVERAGE | 98.0 | -0.9 | -1.2 | 14.4 | 0.0 | 1.8 | 385 | 95 | 70 | -0.02 | -0.14 |
| | STDEV | 0.2 | 0.1 | 0.1 | 0.1 | 0.1 | 0.1 | 12 | 5 | 24 | 0.03 | 0.02 |
| | | | | | | | | | | | | |
| TEST 3 | AVERAGE | 97.9 | -0.7 | -1.1 | 9.7 | -6.2 | 1.8 | 393 | 45 | 79 | 0.14 | 0.06 |
| | STDEV | 0.1 | 0.0 | 0.0 | 0.2 | 0.2 | 0.0 | 10 | 3 | 20 | 0.01 | 0.01 |
| | | | | | | | | | | | | |
| TEST 4 | AVERAGE | 97.9 | -0.7 | -1.2 | 12.4 | -2.9 | 1.8 | 390 | 74 | 69 | 0.33 | -0.04 |
| | STDEV | 0.2 | 0.1 | 0.1 | 0.1 | 0.2 | 0.0 | 14 | 11 | 30 | 0.01 | 0.02 |
| | | | | | | | | | | | | |
| TEST 5 | AVERAGE | 98.1 | -0.7 | -1.2 | 15.3 | 0.9 | 1.8 | 380 | 99 | 72 | 0.22 | -0.18 |
| | STDEV | 0.2 | 0.1 | 0.1 | 0.2 | 0.1 | 0.1 | 10 | 5 | 21 | 0.02 | 0.02 |

FIG. 12

| | | BALL KINEMATICS | | | | | | BALL TRAJECTORY | | |
|---|---|---|---|---|---|---|---|---|---|---|
| | | VELOCITY | LAUNCH | AZIMUTH | BACKSPIN | SIDESPIN | RIFLESPIN | CARRY | DEVIATION | TOTAL |
| | | (mph) | (deg) | (deg) | (rpm) | (rpm) | (rpm) | (yds) | (yds) | (yds) |
| TEST 1 | AVERAGE | 143.8 | 11.4 | -2.5 | 3670 | -37 | 126 | 228 | -10 | 245 |
| | STDEV | 0.7 | 0.4 | 0.3 | 115 | 123 | 206 | 2 | 4 | 2 |
| | | | | | | | | | | |
| TEST 2 | AVERAGE | 143.1 | 12.0 | -1.6 | 3993 | -615 | 105 | 224 | 12 | 239 |
| | STDEV | 0.5 | 0.3 | 0.4 | 96 | 66 | 103 | 2 | 2 | 2 |
| | | | | | | | | | | |
| TEST 3 | AVERAGE | 144.3 | 9.0 | -4.9 | 2755 | 1256 | 47 | 203 | -60 | 232 |
| | STDEV | 0.6 | 0.1 | 0.1 | 63 | 141 | 67 | 5 | 2 | 4 |
| | | | | | | | | | | |
| TEST 4 | AVERAGE | 143.2 | 12.7 | -3.0 | 2875 | 420 | 58 | 229 | -29 | 251 |
| | STDEV | 0.5 | 0.5 | 0.3 | 92 | 166 | 165 | 3 | 5 | 3 |
| | | | | | | | | | | |
| TEST 5 | AVERAGE | 142.8 | 14.1 | -1.0 | 3802 | -622 | 58 | 227 | 16 | 240 |
| | STDEV | 0.6 | 0.2 | 0.2 | 146 | 187 | 113 | 1 | 6 | 1 |

*FIG. 13*

SHOT TABLE

ANALYSIS | DATABASE | SYSTEM | DELETE SHOT

| 427 9.5 DRIVER REG R 45.5 PRO V1 | AVG. | ◁ 25 | 24 | 23 | 22 ▷ | |
|---|---|---|---|---|---|---|
| CLUB SPEED | 109.6 | 107.2 | 110.0 | 108.0 | 111.1 | mph |
| ATTACK ANGLE | -0.4 | 0.9 | 0.0 | 0.0 | 1.0 | deg |
| PATH ANGLE | 4.2 | 5.0 | 4.7 | 5.0 | 4.7 | deg |
| LOFT ANGLE | 13.3 | 12.7 | 11.8 | 12.0 | 15.9 | deg |
| FACE ANGLE | 5.1 | 4.7 | 4.7 | 4.7 | 5.3 | deg |
| DROOP ANGLE | 11.2 | 10.4 | 11.0 | 11.0 | 12.6 | deg |
| VERTICAL IMPACT | 0.07 | 0.22 | 0.30 | -0.22 | -0.03 | in |
| HORIZONTAL IMPACT | -0.41 | -0.72 | 0.10 | -0.15 | -0.73 | in |
| BALL SPEED | 162.3 | 161.5 | 164.0 | 163.7 | 164.2 | mph |
| LAUNCH ANGLE | 12.6 | 10.3 | 11.5 | 11.8 | 14.3 | deg |
| SIDE ANGLE | 1.9 | 3.6 | 0.0 | 2.3 | 3.4 | deg |
| BACK SPIN | 3042 | 3290 | 2600 | 2714 | 3665 | rpm |
| SIDE SPIN | 21 | -30 | -150 | -213 | 542 | rpm |
| RIFLE SPIN | 184 | 214 | 122 | 122 | 75 | rpm |
| CARRY DISTANCE | 251.7 | 253.1 | 265.2 | 260.4 | 236.5 | yds |
| CARRY DEVIATION | 8.4 | 21.3 | 17.1 | 32.8 | -24.0 | yds |
| TOTAL DISTANCE | 252.5 | 253.9 | 266.0 | 261.0 | 236.6 | yds |
| TOTAL DEVIATION | 8.4 | 21.3 | 17.1 | 32.9 | -24.0 | yds |

FIG. 17

LAUNCH MONITOR

CROSS-REFERENCE TO RELATED APPLICATIONS

The present invention is a Continuation-in-Part of U.S. patent application Ser. No. 10/861,443, entitled "Launch Monitor," filed Jun. 7, 2004 now U.S. Pat. No. 7,395,696.

FIELD OF THE INVENTION

The present invention relates to a launch monitor. More specifically, the present invention relates to a portable launch monitor that includes substantially all of its functional components on or within a single housing, and having a graphical user interface and database structure that provides unique and novel capabilities.

BACKGROUND OF THE INVENTION

Over the past thirty years, camera acquisition of a golfer's club movement and ball launch conditions have been patented and improved upon. An example of one of the earliest high speed imaging systems, entitled "Golf Club Impact and Golf Ball Monitoring System," to Sullivan et al., was filed in 1977. This automatic imaging system employed six cameras to capture pre-impact conditions of the club and post impact launch conditions of a golf ball using retroreflective markers. In an attempt to make such a system portable to outside testing, patents such as U.S. Pat. Nos. 5,471,383 and 5,501,463 to Gobush disclosed a system of two cameras that could triangulate the location of retroreflective markers appended to a club or golf ball in motion.

Systems such as this allowed the kinematics of the club and ball to be measured. Additionally, systems such as this allowed a user to compare their performance using a plurality of golf clubs and balls. In 2001, U.S. Patent App. No. 2002/01558961, entitled "Launch Monitor System and a Method for Use Thereof," was published. This application described a method of monitoring both golf clubs and balls in a single system. This resulted in an improved portable system that combined the features of the separate systems that had been disclosed previously. In Dec. 5, 2001, the use of fluorescent markers in the measurement of golf equipment was disclosed in U.S. Patent App. No. 2002/0173367.

However, these prior inventions do not provide an apparatus that includes portability and state of the art imaging technology. These systems also failed to utilize data networks, such as the Internet, to transfer information to a database that is capable of maintaining historical knowledge of a players performance and characteristics. Furthermore, a continuing need exists for a battery operated apparatus that is portable and includes wireless networking that further improves the ease of use.

SUMMARY OF THE INVENTION

The tools that are often used to aid competitive golf players are commonly referred to as Launch Monitor. A launch monitor typically includes an imaging system that is capable of imaging dynamic events such as the motion of the golfers club, balls, or body. The image may include one or more image frames. The image or images may then be analyzed using a desired mathematical algorithm that enables the kinematic characteristics of the club, ball, or body to be determined.

Because of the complexity of the analysis, launch monitors often include many parts including, but not limited to, a camera, a processor, a strobe, a trigger, and a visual display. These parts often make the launch monitor large, or difficult to maneuver. Some launch monitors may have multiple parts distributed over a given area or may require assembly at the test location. This makes the launch monitor difficult to transport, setup, and/or calibrate. In most instances, a golf player must go to the location of the launch monitor, rather than using the launch monitor at any location on a golf course.

In one embodiment, the present invention comprises an apparatus for measuring golf club and ball kinematics. This embodiment includes a camera system capable of acquiring a plurality images of a field of view. The camera system may be powered by a self contained power cell that is capable of providing power to the apparatus for at least two hours. Having a self contained power cell allows the apparatus to be capable of being moved to a plurality of locations based on at least two rolling devices, which may comprise at least two wheels. In some embodiments, the self contained power cell may be rechargeable. In one embodiment, the self contained power cell is capable of providing power for at least four hours. However, in other embodiments, it may be capable of providing power for at least eight hours.

In one embodiment, the self contained power cell comprises a battery, which may be selectively positioned within a housing. Preferably, the battery comprises about 10% or less of the space within the housing. In one embodiment, the battery may comprise a nickel metal hydride battery or a lithium ion battery. The self-contained power cell may have 50 or more watt/hours of power. In another embodiment, the self-contained power cell has 250 or more watt/hours of power. In other embodiments, however, the self-contained power cell has 500 or more watt/hours of power.

In one embodiment, the present invention includes a housing that is sized and configured to hold the camera system and the self-contained power cell. The apparatus may also comprise an electronic display that is integrally formed in the housing. In some embodiments, the electronic display has a diagonal size of about 11 inches or greater.

In one embodiment, the present invention may be capable of determining golf club kinematic information selected from the group consisting of club head speed, club head path angle, club head attack angle, club head loft, club head droop, club head face angle, club head face spin, club head droop spin, club head loft spin, and ball impact location on the golf club face. In another embodiment, the present invention may also be capable of determining golf ball kinematic information selected from the group consisting of ball speed, ball elevation angle, ball azimuth angle, ball back spin, ball rifle spin, ball side spin, and ball impact location on the golf club face. Preferably, the kinematic information is acquired based on four cameras and at least two light sources that are capable of illuminating the field of view.

In another embodiment, the present invention comprises a method for measuring golf club and ball kinematics that includes providing a portable housing and selectively positioning a battery within the portable housing. In this embodiment, the battery is capable of providing operating power for at least two hours. In other embodiments, the battery may be capable of providing operating power for at least four hours or eight hours. In this embodiment, the portable housing is based on at least rolling devices, which may comprise two wheels.

In one embodiment, the present invention comprises a method for measuring the kinematics of a golf object comprising storing image reference information for a plurality of golf objects. An image of at least one of the golf objects in motion may then be acquired. The golf object may be automatically identified based on a comparison to the stored image reference information. The stored image reference information is based on inherent features of said golf objects. The automatic identification may be performed at a rate of about six seconds or less. However, in other embodiments the rate may be about three seconds or less, or alternately about one second or less.

This embodiment further comprises providing an imaging system having a resolution of greater than about 0.5 lp/mm, 1 lp/mm, or 5 lp/mm. The imaging system may be used to detect inherent features of the golf objects, which may include one or more of a logo, an indicia printed on the surface of the golf object, or a geometric profile of the object. The stored image reference information may comprise Eigen values for the plurality of golf objects. In this embodiment, the step of automatically identifying the at least one golf object comprises calculating the Eigen value of the at least one golf object from the acquired image and comparing it to the stored image reference information.

In one embodiment, at least one golf object has a marker applied to an outer surface in order to allow an object to be recognized. Alternately, the outer surface of the at least one golf object comprises at least 3 markers. Preferably, the markers, which may be fluorescent or retroreflective, are capable of creating a high contrast with the surface of the at least one golf object.

In one embodiment, the stored image reference information comprises information for 50 or more golf objects. In another embodiment, the stored image reference information comprises information for 200 or more golf objects. Alternately, stored image reference information may comprise information for 500 or more golf objects.

In another embodiment, the present invention comprises a system for measuring the kinematics of a golf object comprising at least one camera system and a computational device capable of automatically identifying an acquired image from a library of stored reference information. In this embodiment, the computational device is capable of automatically identifying the acquired image in about six seconds or less. However, in other embodiments the computational device may be capable of identifying the acquired image in about three seconds or less, or alternately in about one second or less.

This embodiment also includes an imaging system having a resolution of greater than about 0.5 lp/mm, 1 lp/mm, or 5 lp/mm. The imaging system may be used to acquire the stored reference information, which is preferably based on inherent features of the golf objects. In one embodiment, the automatic identification is based on Eigen values.

In another embodiment, the present invention comprises an apparatus for determining golf club and ball kinematics comprising a camera system having a field of view and a display device. This embodiment also includes a teeing aid that is capable of assisting a golfer in placing the golf ball within the camera's field of view in order to locate the ball within a predetermined teeing position. Preferably, the teeing aid is capable of grabbing and sequentially presenting a plurality of video images. The images may have a frame rate, which may be greater than about 5, 10, or 20 frames/sec.

In one embodiment, the teeing aid has a field of view. The field of view may be greater than about 2"×4" or about 4.5"×6.5". The field of view is preferably illuminated by at least one light source. Preferably, the light source comprises a light emitting diode. The teeing aid may be persistently or selectively activated. Alternately, the teeing aid may be automatically deactivated after detecting the presence of a golf ball.

In one embodiment, the field of view comprises a substantially square grid. The grid may include a plurality of smaller squares having dimensions at least equal to the diameter of the golf ball. The square grid preferably allows the present invention to be capable of measuring an existing ball location based on the plurality of smaller squares and instructing a user to move the golf ball. A user may be instructed to move the golf ball downrange, uprange, toward a golfer, or away from a golfer.

In one embodiment, the present invention further comprises at least one trigger. Preferably, the at least one trigger requires no readjustment for left or right handed golfers. The trigger may comprise an optical trigger including a laser, an ultrasonic trigger, a rapid response trigger, or a discrete logic device. The trigger is preferably capable of determining the timing of the at least one light source and camera based on a look-up table. In some embodiments, the look-up table comprises at least 20 categories.

In another embodiment, the present invention comprises a method for determining golf club and ball kinematics comprising grabbing and sequentially presenting a plurality of video images using a teeing aid. The method also includes selectively activating at least one light source that is capable of illuminating the field of view presented by the teeing aid.

In another embodiment, the present invention comprises an apparatus for measuring club and ball kinematics. The apparatus includes a camera system, at least one trigger operatively connected to the camera system, a processor capable of running an operating system, and a handheld remote control for interacting with the operating system. The remote control may operate within the radio frequency spectrum or infrared frequency spectrum. Alternately, the remote control may be connected to the housing based on a cable or it may be hardwired to the housing.

In embodiments where the remote control operates within the radio or infrared spectrums, the operating system is preferably capable of identifying the handheld remote associated with the apparatus such that it only responds to its associated handheld remote. The remote control may be stored within the housing. In one embodiment, the present invention also includes a graphical user interface. The graphical user interface may be capable of displaying the impact position on a photo-realistic graphic image of a club face. The graphical user interface may be capable of displaying a carry plot. The carry plot may illustrate a plan view of calculated ball landing positions on a fairway or a plan view of golf ball trajectory and an elevation view of golf ball trajectory. The plan view may include multiple shots on the same carry plot. Preferably, a current shot is highlighted in a different color from one or more previous shots. The graphical user interface may also be capable of illustrating the orientation and direction of motion of a club head, the direction of motion of a golf ball, and comparison charts.

In one embodiment, the comparison chart may include multiple impact positions on a club face, or a landing plot capable of graphically depicting the landing positions of ball struck using different clubs. In some embodiments, multiple trajectories may be placed on the same plot. In other embodiments, the graphical user interface may be capable of displaying a contour plot illustrating carry distance or total distance of a ball as a function of backspin rate and launch angle at a particular speed.

In one embodiment, the graphical user interface includes drop down menus. A user may navigate between the drop down menu's and multiple displays by using a handheld remote. Preferably, the remote allows a user to navigate in at least four directions. It may be desirable to allow the graphical user interface to include graphic icons that are used to inform a user of a system status. System status may include the battery level, AC power, operating mode, network status, ready status, and trigger status of the apparatus.

In another embodiment, the present invention comprises a method for determining club and ball kinematics. The method includes providing a processor capable of running an operating system and providing a remote control for interacting with the operating system. The remote control may be based on radio frequency identification.

In another embodiment, the present invention comprises a method for determining club and ball kinematics. The method includes the steps of providing an apparatus comprising a camera system capable of acquiring a plurality of images of a field of view and a processor capable of running an operating system. The method also includes providing a network capability capable of interacting with the operating system wherein the network is capable of interacting with remote data processing devices. In one embodiment, the network comprises a wireless network, standard Ethernet connection, or a telephone modem. The network is preferably capable of transferring data at a rate of 1 Mbps, 5 Mbps, 10 Mbps, or more. In this embodiment, the remote data processing devices may comprise a laptop computer or a display device.

In one embodiment, the network may be used to transfer data to a central server to display a golfer's characteristics, such as club characteristics, ball characteristics, ball trajectory, equipment comparison, and the like. In other embodiments the network may be capable of transmitting transaction information, such as an equipment order, financial information of a purchaser, a shipping address, and salesperson information, to a central server. Additionally, the network may be capable of transmitting order confirmation information, updating software for the operating system, transferring data to multiple data consumers, and the like.

In one embodiment, the present invention comprises an apparatus for determining golf club and ball kinematics. The apparatus comprises a camera system capable of acquiring a plurality of images of a field of view, and a networking device capable of interacting with a processor. The networking device is preferably capable of interacting with a remote data processing device.

In another embodiment, the present invention comprises an apparatus for determining golf club and ball kinematics. This embodiment includes a camera system capable of acquiring a plurality of images of a field of view and a wireless networking device capable of interacting with a processor. The wireless networking device is preferably capable of interacting with a remote data processing device.

In another embodiment, the present invention comprises a method for determining club and ball kinematics. The method comprises the steps of providing an apparatus comprising a camera system capable of acquiring a plurality of images of a field of view and a processor capable of running an operating system. The method further includes providing a network capability capable of interacting with the operating system. In this embodiment, the network is capable of interacting with remote data processing devices. In this embodiment, the club and ball are preferably automatically identified.

In another embodiment, the present invention comprises a method for determining club and ball kinematics. The method includes providing an apparatus comprising a camera system capable of acquiring a plurality of images of a field of view, a processor capable of running an operating system, and a self contained power cell. The method also includes providing a network capability capable of interacting with the operating system. In this embodiment, the network is capable of interacting with remote data processing devices.

In one embodiment, the self contained power cell comprises a battery, which may be rechargeable. The battery may be, for example, a nickel metal hydride battery or a lithium ion battery. In one embodiment, the self contained power cell may have 50 or more watt/hours of power.

BRIEF DESCRIPTION OF THE DRAWINGS

FIG. 2 is a table showing an exemplary lookup table structure employed by an FPGA algorithm;

FIG. 11 is a table illustrating data acquired using an exemplary launch monitor in accordance with the present invention;

FIGS. 12 and 13 are tables showing the average and standard deviations measured for each kinematic characteristic;

FIGS. 15-17 are diagrams showing a kinematic analysis of a club;

DETAILED DESCRIPTION OF THE PREFERRED EMBODIMENTS

Figure 1:
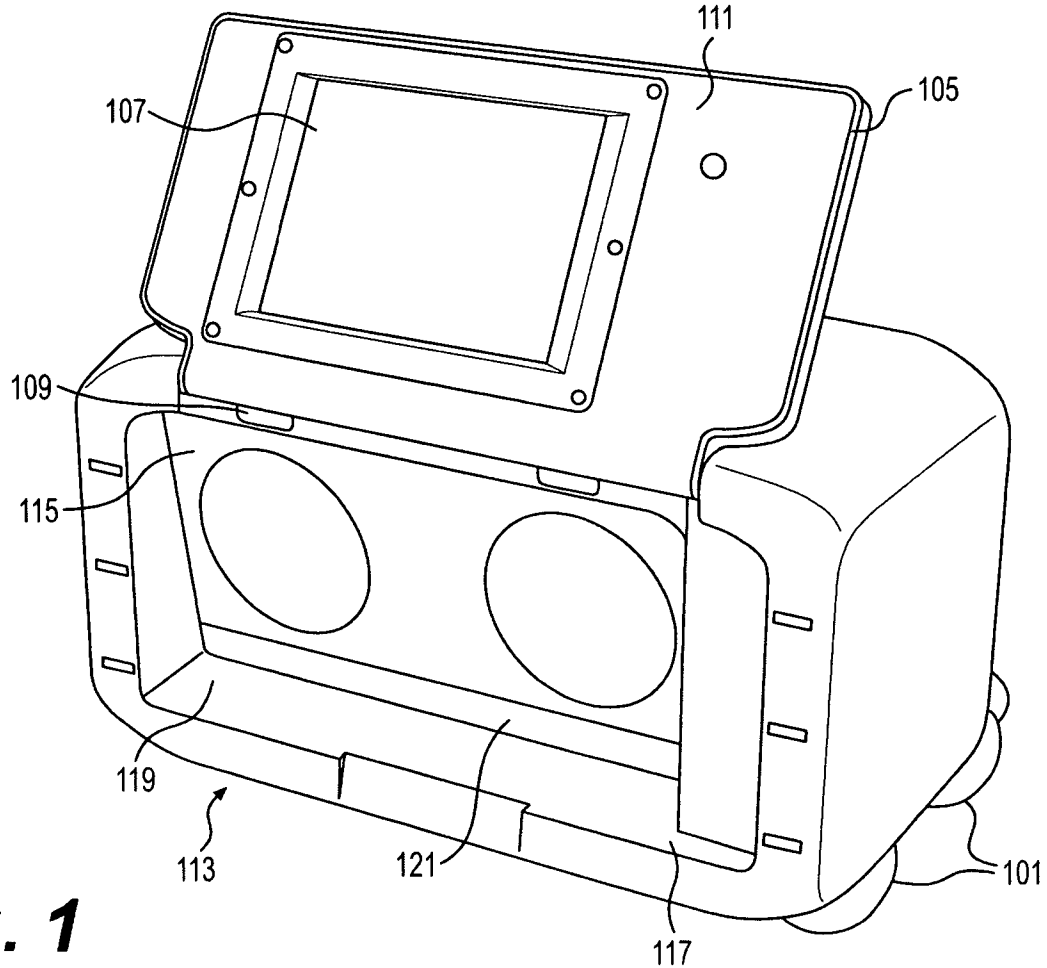
FIG. 1 is a diagram showing one embodiment of an exemplary portable housing.

Competitive athletes are constantly in search of tools to fine-tune each aspect of their game. For competitive golf players, the key to improvement often entails selection of equipment which optionally fits their specific swing characteristics. Thus, a competitive golf player is constantly searching for tools that enable them to observe and analyze alternative equipment as well as each aspect of their swing. By doing so, a player can make changes necessary for achieving optimal performance, which may ultimately lead to a better score.

The tools that are often used to aid competitive golf players are commonly referred to as Launch Monitor. A launch monitor typically includes an imaging system that is capable of imaging dynamic events such as the motion of the golfers club, balls, or body. The image may include one or more image frames. The image or images may then be analyzed using a desired mathematical algorithm that enables the kinematic-characteristics of the club, ball, or body to be determined.

Because of the complexity of the analysis, launch monitors often include many parts including, but not limited to, a camera, a processor, a strobe, a trigger, and a visual display.

These parts often make the launch monitor large, or difficult to maneuver. Some launch monitors may have multiple parts distributed over a given area or may require assembly at the test location. This makes the launch monitor difficult to transport, setup, and/or calibrate. In most instances, a golf player must go to the location of the launch monitor, rather than using the launch monitor at any location on a golf course.

It is typically desirable for launch monitors to be capable of monitoring the swings of both right handed and left handed players. However, many prior art launch monitors either lack this capability or requiring significant mechanical intervention in order to achieve it. The mechanical intervention required by prior art monitors may include, but is not limited to, rearrangement of the trigger, camera, flash, and the like. Typically prior art monitors have to be realigned, recalibrated, readjusted, and moved to achieve the capability to monitor both left and right handed players. This often results in significant downtime and complexity. Often, the precision and accuracy of the measurements acquired by the launch monitor may be compromised in the process.

The present invention comprises a launch monitor that includes substantially all of its functional components on or within a housing. In a preferred embodiment, the launch monitor is capable of being transported and used in any desired location. One or more camera's, flashes, and triggers may be used to acquire images of a golf club and golf ball. The launch monitor is preferably capable of receiving and transmitting data over a wireless network.

The acquired images and other data may be analyzed by a processor, and then displayed using an LED, LCD or other type of display or printer. In one embodiment, the launch monitor may "recognize" a plurality of golf clubs and golf balls based on an optical fingerprint. The optical fingerprints, which are preferably stored in a memory, allow the launch monitor to identify a golf club and/or ball substantially soon after they are placed in the field of view of the monitor Optical fingerprinting enables automatic record keeping, and storing performance data and equipment used simultaneously. In another embodiment, the launch monitor may recognize a plurality of golf clubs based on Radio Frequency Identification (RFID). These features eliminate tedious record keeping, data entry errors, and enable rapid equipment optimization.

To ensure accuracy, the golf ball is preferably placed at a desired point within the field of view of the launch monitor. In one embodiment, a player may determine where to place the ball based on a teeing aid that helps the player determine proper placement of the ball. In a preferred embodiment, a teeing aid provides video images of the ball on a display. Alternatively, the teeing aid may illuminate an area where the ball may be placed where it will be within the lines of sight of cameras used by the launch monitor. A user may determine when the placement of the ball is correct based on the displayed image or alternatively upon the ball's placement in the illuminated area.

In one embodiment, the launch monitor has a fixed field of view. Thus, the kinematic characteristics of the ball are determined based on images of the ball that are taken soon after impact with the golf club. In order to determine the trajectory of the ball, a trajectory model is preferably employed. In one embodiment, the trajectory model is based on aerodynamic coefficients that are obtained using an indoor test range.

In one embodiment, the launch monitor may be capable of monitoring the kinematic characteristics of a golf club and ball for both left and right handed players. In one embodiment, the launch monitor does not have to be recalibrated, moved, or realigned. In another embodiment, the launch monitor may be rotated about an axis in order to monitor both left and right handed players. One advantage of these embodiments is that the accuracy and precision of the measurements for left and right handed golfers is substantially similar.

Prior art launch monitors that are capable of monitoring both left and right handed golf players typically required equipment to be marked with different types of markers when monitoring left or right handed players. For example, a club may be marked with fluorescent markers for a right handed player, and with retroreflective markers for a left handed player. Often, using different markers for left and right handed players results in a disparity between the measurements for each type of player. In one embodiment of the present invention, the launch monitor may be capable of monitoring both right and left handed players based on the same set of markers, with substantially similar precision and accuracy, as discussed in more detail below.

Housing

In one embodiment, the housing is configured and dimensioned to hold substantially all of the functional components of the launch monitor. In this embodiment, the functional components may be housed within, or on the surface of, the housing. Additionally, other non-functional components, such as calibration equipment, may be housed on or within the housing.

An exemplary housing is shown in FIG. 1. As shown in the FIG. 1 embodiment, the housing is portable. Preferably, the housing may be easily pushed or pulled by one person. To aid in moving the housing, one or more wheels 101 may be included. The wheels 101 may be placed at one or more desired points on the housing. The dimensions of each wheel are preferably chosen such that they are capable of distributing the weight of the housing.

In some embodiments, the present invention may be used on soft surfaces, such as the grass on a golf course. When small, narrow wheels are used to support large loads on soft surfaces, they often cause the wheels to sink into the surface, rendering them ineffective. In one embodiment, there are preferably two wheels 101. In this embodiment, the wheels according to the present invention have a wide tread in order to avoid sinking into soft surfaces. The wide tread allows the wheels to distribute the weight of the launch monitor over a larger surface area. Preferably, the tread of the wheels is between about 1 and 4 inches wide. More preferably, the tread of the wheels is between about 1.25 and 2.5 inches wide, and most preferably the tread of the wheels is between about 1.75 and 2.25 inches wide. In other embodiments, rollers or other devices may be used to aid with portability.

In one embodiment, an extensible handle 103 may be included in the housing in order to allow the launch monitor to be easily transported. The extensible handle 103 should be of a sufficient length to allow a user to easily push or pull the launch monitor. In one embodiment, the sufficient length may be measured in terms of the wheel to handle grip length. In a preferred embodiment, the length is preferably between about 3 and 6 feet. More preferably, the length is between about 3.5 and 5 feet, and most preferably, the length is between about 3.75 and 4.25 feet.

In one embodiment, the housing may include one or more lids 105. Each lid 105 may have a different size, and is preferably capable of being opened or closed about a hinge. In a preferred embodiment, when the lid is in the closed position, it is capable of maintaining a weather resistant seal. The weather resistant seal is preferably capable of preventing a substantial amount of moisture from entering the housing. In a preferred embodiment, when the lid is shut, the weather resistant seal preferably meets at least a NEMA-5 standard.

As described above, it is desirable for the present invention to be portable. Accordingly, it is desirable to minimize the total weight of the housing and its components. Preferably, the total weight of the present invention is less than 100 lbs. More preferably, the total weight is less than 70 lbs, and most preferably the total weight of the present invention is less than 50 lbs.

As previously described, the housing is preferably capable of enclosing all of the functional and non-functional components necessary for the launch monitor to function. However, in order to ensure that the present invention is portable, it is desirable to minimize the total volume of the housing. Along these lines, the housing can have any shape or dimensions, while remaining within a desired volume. Preferably, the volume of the housing is about 4 cubic feet or less. More preferably, the volume of the housing is about 2 cubic feet or less, and even more preferably it is about 1.5 cubic feet or less.

As discussed above, the housing may include one or more lids 105 that are capable of being opened and closed about a hinge. In a preferred embodiment, the lid 105 includes an integrated display 107. The display 107 is preferably positioned on the inner surface of the lid 105. This allows the display 107 to be protected from moisture by the weatherproof seal, as previously discussed.

The angle of the lid 105, which includes the integrated display 107, may be adjusted in order to make it easier for a player to view. In one embodiment, the lid 105 may be adjustable with a torsional resistance hinge 109, similar to a laptop computer hinge. The hinge 109 may be capable of being adjusted, while allowing the screen to maintain a desired position. In another embodiment, the lid 105 may be rotatable about a swivel connection. The swivel connection preferably allows the lid 105 to be opened and rotated 360 degrees. This would allow a user to view the display 107 when standing behind, or to the side of, the launch monitor.

As will be discussed in more detail below, the present invention may be capable of being controlled remotely, via a remote control 111. Preferably, the remote control 111 is stored within the housing. In one embodiment, the remote control 111 may be stored in a receptacle within the lid 105. In one embodiment, the remote control 111 is capable of operating within the radio frequency (RF) spectrum, and thus does not need to be hard wired to the launch monitor. In such an embodiment, the remote control 111 may be selectively removable from the receptacle when in use. Preferably, the RF remote is small, hand-held, and battery powered. Preferably, the hand-held remote has a volume of about 20 cubic inches or less. In other embodiments of the invention, the hand-held remote is about 10 cubic inches or less, or even may be about 5 cubic inches or less.

In embodiments where the remote control 111 is not hard wired to the launch monitor, it may be desirable for each remote 111 to operate at a desired frequency. This may be particularly desirable in embodiments where more than one launch monitor is being used in close proximity. In such an embodiment, tuning each remote 111 to a different frequency allows each launch monitor to only communicate with the remote 111 with which it is associated. One advantage of having different remotes tuned to different frequencies is that cross-talk, or other types of interference may be prevented. In other words, each launch monitor may be capable of responding to the remote 111 associated with it, while allowing other launch monitors to communicate with their respective remotes 111. The remote 111 may operate within radio frequency or infrared spectrums. Alternately, the remote 111 may communicate with each launch monitor based on radio frequency identification.

As shown in the FIG. 1 embodiment, the present invention includes a face 113, which preferably faces the golf player. In one embodiment, the face 113 of the launch monitor is configured and dimensioned from cast aluminum. The face 113 preferably includes one or more camera assemblies and at least one trigger, each of which will be discussed in more detail below. The face 113 of the launch monitor also includes the hinged lid 105, which includes the integrated display 107. In this embodiment, the cast aluminum face 113 provides an electrical ground for electronic equipment. In other embodiments, other materials capable of providing an electrical ground may be used. This may include, but is not limited to, any known metal.

In a preferred embodiment, the launch monitor also includes an area for storage of additional equipment. This equipment may include both functional and non-functional devices. In one embodiment, a storage area for calibration equipment fits within the housing. The storage area allows substantially all of the equipment necessary for the launch monitor to function to be housed within a single unit. In addition, storing additional equipment within the housing allows the additional equipment to be isolated from environmental factors, such as moisture, by a weather resistant seal.

Figure 20A:
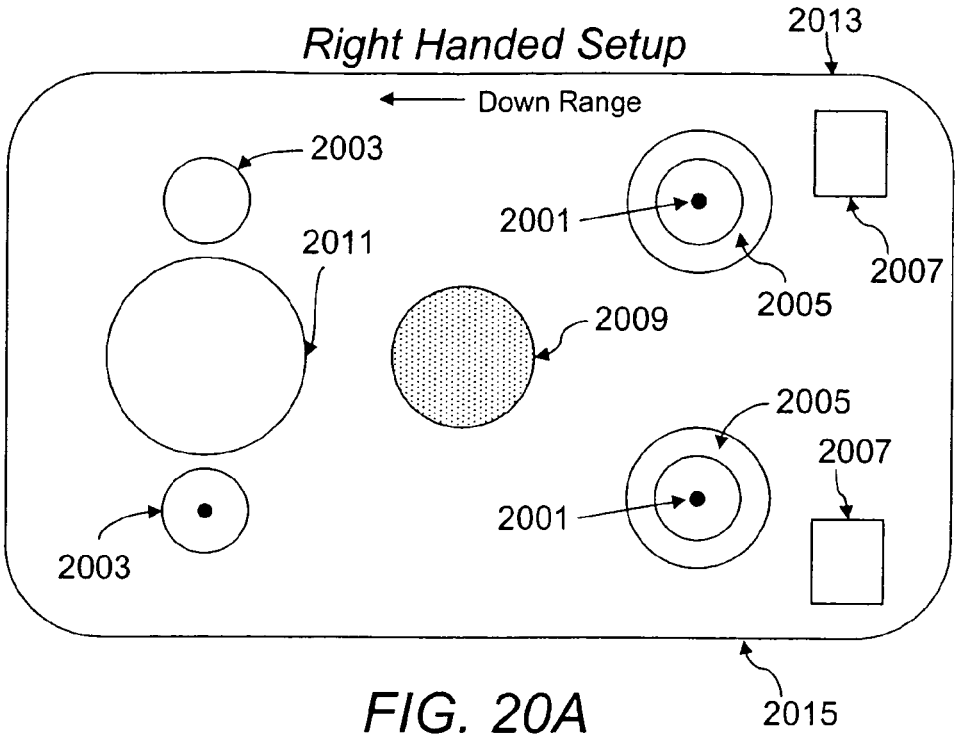
FIGS. 20A and 20B are diagrams showing one embodiment of the face according to the present invention.

In one embodiment, the housing may be capable of adjusted in order to monitor right or left handed players. The adjustments that may be made include, but are not limited to, rotating, flipping, and the like. As described above and shown in FIGS. 20A and 20B, one embodiment the present invention may be capable of being used to monitor both left and right handed golf players. FIG. 20A is a diagram showing one embodiment of the present invention that is configured to monitor a right handed player. The configuration shown in the FIG. 20A embodiment may also be used to monitor a left handed golf player. This may be accomplished in any desired manner, such as by rotating the entire housing of the launch monitor about an axis line through the teeing aid shown in FIG. 20A to obtain the orientation in FIG. 20B.

Figure 20B:
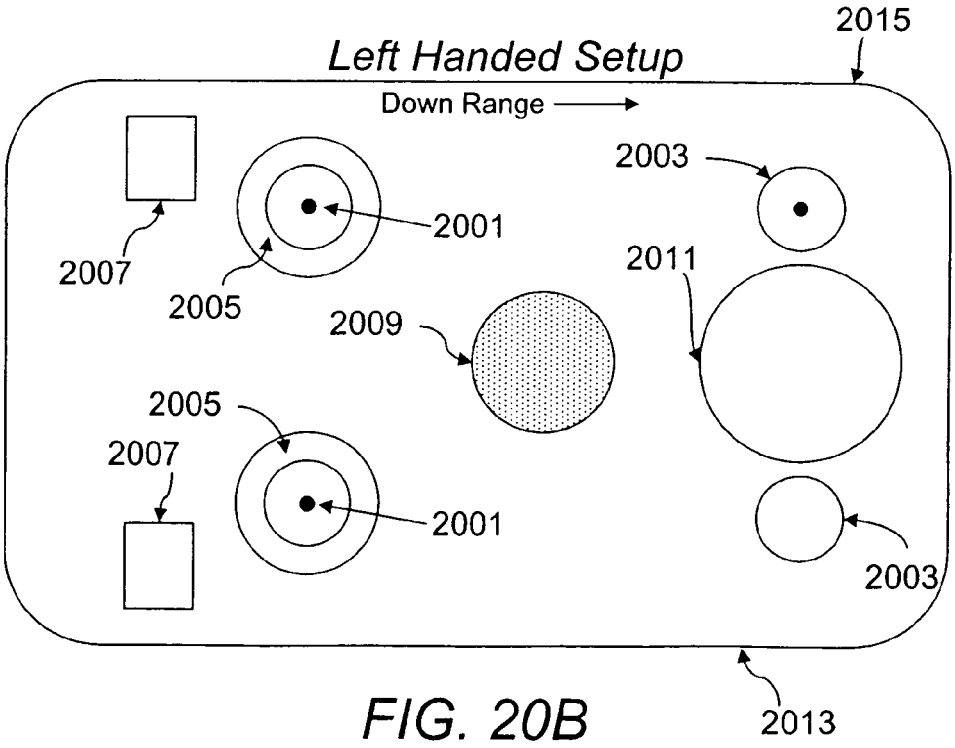

In one embodiment, the FIG. 20A embodiment may be flipped about an axial axis in order to obtain the FIG. 20B embodiment. For example, the FIG. 20A embodiment may be rotated about an axis passing through the teeing aid in order to obtain the FIG. 20B embodiment. In another embodiment, the FIG. 20B embodiment may be obtained by rotating the housing of the launch monitor about a longitudinal axis. This may be advantageous in many applications. For example, the FIG. 20A embodiment may be used to monitor a right handed player. Then, by rotating the housing about a longitudinal axis, the housing may be flipped to face the opposite side, resulting in the FIG. 20B embodiment. A left handed player may then position himself in front of the launch monitor and proceed to strike a golf ball facing the same hitting direction as the right handed player. In this embodiment, the housing may be rotated a desired number of degrees such that the cameras 2001, 2003 are capable of acquiring images of the golf ball and club. As described below, the housing may be rotated according to the angle of the cameras 2001, 2003, such that the bottom cameras are substantially parallel with level ground. In one embodiment, the angle of the housing may be determined based on any type of level, such as a bubble float and the like.

In the embodiment where the housing is rotated about one of the mentioned axes, three or more "feet" may be selectively positioned on the top 2013 and bottom 2015 of the housing. The feet are preferably capable of supporting the weight of the launch monitor on a level surface. In the embodiment where the housing may be rotated about a longitudinal axis, the housing may be supported by an apparatus that is capable of allowing the housing to rotate. For example, such an apparatus may include a separate base and at least two arms that contact the sides of the housing at desired points. The length of the arms is preferably sufficient to allow the housing to rotate without hitting the ground. In this embodiment, it may be desirable to allow the housing to be locked in place once a desired position is achieved. In other embodiments, the base may include more than one set of arms such that the housing may be rotated about an axis passing through the face plate as well as about a longitudinal axis.

Realignment and Leveling

In a preferred embodiment, the present invention substantially reduces the drawbacks that are typically associated with using a launch monitor. It is desired that the present invention is capable of being used in any environment, with minimal adjustment and calibration. In instances where the launch monitor needs to be calibrated, it is desired that the time and manpower required to accomplish the calibration is substantially reduced.

Prior art launch monitors typically exhibit several problems when they are not used in a controlled environment such as a test range. A common problem is that prior art camera assemblies typically have a small field of view, such as 4×6". In order to acquire images of the golf club and golf ball during motion, these small fields of view require the golf ball to be precisely located.

The present invention substantially reduces the need for precise ball location. In the FIG. 1 embodiment, four camera assemblies 115 are shown. One or more, or all of the camera assemblies 115 may have a field of view that is about 50 square inches or greater in size. More preferably, the field of view of a camera is about 100 square inches or greater, and even more preferably it is about 200 square inches or greater. Alternatively, the field of view of a camera may be described to cover an area of at least from about 6"×8" to about 12"×20". More preferably, the field of view covers an area from about 7"×9" to about 10"×14", and most preferably the field of view of each camera assembly covers an area from about 8"×10" to about 9"×12". Other aspects of the camera assemblies will be discussed in more detail below.

Having a larger field of view allows each camera assembly 115 to acquire images of a golf ball without any clearance from the ground. In one embodiment, the present invention includes four camera assemblies 115. It is desired that two camera assemblies are selectively positioned to acquire images of the golf club, while the other two camera assemblies are selectively positioned to acquire images of the golf ball. In this embodiment, the field of view of each camera assembly 115 preferably overlaps by a small amount, for example, between 0.5 and 1.5 inches. The overlap allows a small amount of redundancy to ensure that images of the entire club and ball may be acquired.

Launch monitors typically require a triggering system, which allows each camera assembly to determine when it should acquire an image, and the appropriate interval between images. The timing of each image, and the interval between images is typically determined by the velocity of the golf club or ball. A triggering system typically must be placed on one side of the launch monitor in order to determined the velocity of a club. Because right and left handed players swing from opposite sides, this requires the triggering system of a launch monitor to be re-positioned and calibrated. In prior art systems, this is typically a time consuming and labor intensive task. In one embodiment of the present invention, the triggering system allows the launch monitor to be used with both right and left handed golfers without substantial calibration or readjustment. The triggering system will be discussed in greater detail below.

Prior art launch monitors often require a flat, level surface to ensure accuracy. However, golf courses typically comprise soft irregular grassy slopes. This either requires special equipment to level the monitor, or it may require a golf player to find a flat surface before using the launch monitor. Additionally, whenever a golf monitor is moved to another location, prior art systems often require recalibration and configuration. This causes prior art launch monitors to be impractical outside of a controlled setting.

In one embodiment, the present invention includes a sensing device that is capable of detecting the angle of inclination of the launch monitor. The sensing device may then communicate with a processor, which is preferably capable of accounting for the angle of inclination when it determines the kinematic characteristics of the golf club and golf ball. In such an embodiment, the present invention does not need to be placed on a flat or level surface. This allows the present invention to analyze a player's swing and resultant ball trajectory under realistic circumstances.

Most launch monitors require calibration in order to ensure accuracy. However, many systems require a user to calibrate a system either periodically, or when they notice that readings are inaccurate. In one embodiment, the present invention is capable of automatically prompting a user for calibration. The prompting may be done in any desired way, such as by an indication on the integrated display, or through another type of indicator, such as an LED that illuminates when calibration is required. In one embodiment, the calibration may be accomplished by acquiring images of a calibration fixture that is stored within the housing. Numerical algorithms and methods for calibrating a launch monitor are well known to those skilled in the art.

In the FIGS. 20A and 20B embodiments, when the housing is adjusted to monitor both right and left handed golf players, it may not be necessary to recalibrate the launch monitor. In this embodiment, the housing is preferably operatively connected to two arms that are supported by a separate base, as described above. The two arms are preferably capable of preventing the launch monitor from moving when it achieves a desired position. Thus, the launch monitor may be rotated by a predetermined number of degrees such that it does not require recalibration to monitor left and right handed players. In one embodiment, the present invention may include an inclinometer. Preferably, the inclinometer may be used to maintain the cameras in the housing at the same orientation for both right and left handed golfers. Thus, the housing may be adjusted by rotating about an axis through the face plate as well as about a longitudinal axis, and the orientation of the cameras relative to the ground may remain substantially the same.

Network

In many applications, it may be desirable to transfer the data acquired by a launch monitor to an electronic memory. In some embodiments, the memory is an electronic database. Transferring data may be desirable in order to perform further analysis on the data, create diagrams or other illustrations, or to track progress over a period of time.

In a preferred embodiment, multiple launch monitors may be used at close proximity to one or more computers, for example at a driving range, or they may be distributed at various locations throughout a golf course. When multiple prior art launch monitors are used at close proximity, they are typically hardwired to a computer in order to enable data transfer. When multiple prior art launch monitors are distributed, the data must either be stored onto a memory within the launch monitor, or it must saved onto a memory storage device, such as a disk, and then transferred to a computer. Though a single computer is discussed, it will be understood that one or more computers may be used in the embodiments described below.

These data transfer situations discussed above cause complications. Hardwiring multiple launch monitors to a computer can require many wires from each monitor. This can result in considerable set-up and removal time. Additionally, it restricts the movement of each launch monitor. Storing data onto a memory within a launch monitor may require significant amounts of storage space, and storing data onto a disk has the obvious disadvantages of being cumbersome, complicated, and time consuming.

In a preferred embodiment, a wireless network is formed between each launch monitor, and a computer that is capable of storing the data. In some embodiments, the computer may be capable of performing analysis or other calculations based on the data. In one embodiment, each launch monitor and computer are capable of receiving and transmitting data. The wireless network allows one or more launch monitors to communicate with the computer through the air, which thereby eliminates the need for hardwiring between a launch monitor and a computer. In addition, launch monitors that are distributed at different points on a golf course do not have to store data from multiple users in a memory, or on a memory storage device.

Additionally, a wireless network may substantially reduce the setup time that is required for each launch monitor. In a preferred embodiment, the computer may communicate wirelessly with each launch monitor to determine whether they are activated, calibrated, functioning correctly, and the like. This substantially reduces the setup time because a technician can focus their attention on a launch monitor that is malfunctioning or needs to be calibrated. However, the technician is preferably able to bypass launch monitors that do not require attention. The reduction in setup time may be especially obvious when launch monitors are distributed over a large area, such as a golf course. In such an embodiment, a computer could direct a technician to a malfunctioning launch monitor. This would eliminate the need for one or more technicians to walk across a large area to verify that each launch monitor was operating correctly.

In another embodiment, it may be desirable to transfer data from each launch monitor to a central database or server. This may be done in several ways. In one embodiment, the data may be transferred from a given launch monitor, to the computer, and then to the server. In this embodiment, the central database or server and the computer may be hardwired together, or they may be capable of communicating via a wide area network (WAN), such as the Internet. In another embodiment, the central database or server may be equipped to transmit and receive data directly from the launch monitor.

In either embodiment, it is desirable to transfer data from the launch monitor to the central database or server in order to provide a golf player with remote access to their data and the kinematic analysis of their swing and ball trajectory. In a preferred embodiment, a player may remotely access the central database or server using, for example, the Internet. In this manner, a user would be able to view their data and kinematic analysis at any time. In one embodiment, this would allow a user to compare and track changes in their swing and resultant ball trajectory over a period of time.

As described above, each launch monitor and computer is preferably capable of receiving and transmitting data wirelessly. In one embodiment, it is desirable to transmit data from a computer to a launch monitor. In this embodiment, data may be transmitted from a central database or server to the computer. As discussed above, this computer connected to the central server or database via hardwire or a WAN.

In some embodiments, it may be desirable to transmit requests for information, or instructions to one or more launch monitors. For example, it may be desirable to update the launch monitor software. In this case, the software upgrade may be transferred from the central server or database to the computer. The computer may then wirelessly transmit the software upgrade to each launch monitor. In other embodiments, it may be desirable to add, remove, or reconfigure the software present in each launch monitor.

As described above with regards to the housing, each launch monitor preferably has an integrated display. In some embodiments, it may be desirable to alter the appearance of the display. This may include changing the graphics, font, colors, information displayed, or the like. In such embodiments, the data necessary to implement these changes may be transferred from the central server or database to each launch monitor.

Alternately, it may be desirable to transmit a request for information from one or more launch monitors. In this embodiment, the request for information could be sent from the central database or server to each launch monitor via the computer. For example, a central database or server may send a request for all of the data collected from a given launch monitor over a desired period of time. Other information, such as self-diagnostic information from each launch monitor, or the like, may be requested. In these embodiments, the request for the data would be sent to the launch monitor, which would then transmit this information back to the central database or server. This may occur directly or via a computer.

In a preferred embodiment, the wireless network may be implemented in any manner known to those skilled in the art. This may include the use of a wireless transmitter and receiver functioning at desired frequencies. In one embodiment, each wireless transmitter is preferably capable of transmitting data a distance of 10 yards or greater. More preferably, each transmitter is capable of transmitting data a distance about 600 yards or greater, and most preferably each transmitter is capable of transmitting data a distance of about 1000 yards or greater.

In one embodiment, any type of data may be transmitted and received by the launch monitor and computer. The data may include, but is not limited to, player equipment, club and/or ball kinematics, sales information, marketing information, or audio or video data regarding one or more monitored golf swings of a player. In a preferred embodiment, data is transmitted at a high rate. The data transmission rate is preferably the same for both the launch monitor and the computer. However, in some embodiments, the data transmission rate may be different. Preferably, the data transmission rate is greater than about 2 Mbps. More preferably, the data transmission rate is greater than about 10 Mbps, and most preferably the data transmission rate is greater than about 50 Mbps.

Cameras

In one embodiment, one or more camera assemblies may be used to acquire images of the golf club and golf ball in motion. In a preferred embodiment, the present invention includes at least two camera assemblies. As described above, one camera assembly is configured and positioned to acquire images of the golf club, while the other camera assembly is configured and positioned to acquire images of the golf ball.

In order to analyze the kinematic properties of the golf club and golf ball, it is desirable that the cameras have short exposure times, with short intervals between consecutive images.

The time intervals typically depends on the velocity of the club and/or ball. As such, it is preferable to have the acquired images transferred to an electronic memory soon after they are acquired by the imaging sensor of each camera. In a preferred embodiment, each camera is attached to a processor, such as a computer.

In one embodiment, a digital processor and digital memory are used to process the acquired images. Because consecutive images are acquired within a short time interval, it is desirable to have a hardwire connection that allows rapid transfer of information between the imaging sensor, memory and the processor. The hardwire bus used should also provide the advantage of flexible interconnectivity. This is particularly important in applications where the total volume of a housing is limited. In a preferred embodiment, the connection between the one or more cameras and the processor is based on a 1394 bus, commonly referred to as a FireWire bus, which is well known to those skilled in the art. A FireWire bus is preferably used because it enables high speed transfer of data at a reasonable cost. In other embodiments, other types of bus', such as PCI express, USB, or Camera Link, may be used.

The bus speed is preferably chosen to maximize the speed of data transfer between the cameras and the processor. Preferably, the bus speed is greater than 100 Mbps. More preferably, the bus speed is greater than about 400 Mbps, and most preferably the bus speed is greater than about 800 Mbps.

In one embodiment, each of the cameras on the launch monitor may be asynchronously triggerable. A synchronously triggerable camera can only trigger a camera to acquire an image when a clock signal is high. This makes the imaging period dependent on the speed of the clock. In many situations, the speed of the clock may not be sufficiently fast enough to allow a camera to acquire images of a rapidly moving object, such as a golf ball or golf club.

On the other hand, an asynchronously triggerable camera may be triggered to acquire an image independently of the clock signal. This allows a camera to acquire an images at shorter intervals. In another embodiment, the asynchronously triggerable camera may be repeatedly triggered. In effect, this would allow the camera to capture video images. This would not be possible with a synchronously triggerable camera because the triggering signal would only be sent to the camera periodically, when the clock signal is high.

An additional benefit of the asynchronous trigger is that each camera shutter time may be controlled independently. This is because each camera may be triggered to activate, or acquire an image, at any interval. In this embodiment, the trigger could activate the first camera to acquire an image of the club. If the triggering system determined that the second camera needed to activate immediately after the first camera, the asynchronous trigger would allow this to happen. In contrast, if a synchronous trigger was employed, the second camera could not be activated until the clock signal was high.

In a preferred embodiment, two cameras are used to capture images of the golf club and golf ball. Preferably, the cameras are able to take multiple images of the golf ball and/or golf club to analyze the movement of the club and/or ball. This may be accomplished using a variety of methods. Preferably, a multi-frame method may be employed. This method is well known to those skilled in the art, and involves taking multiple images in different frames.

More preferably, a method that uses multiple strobing or shuttering in a single frame may be used. In one example of such a method, the shutter of the camera is maintained in an open position for a desired period of time. While the shutter is open, the CCD of the camera is maintained in an activated state, so that the camera is able to acquire multiple images on the same frame. This method is analogous to using an analog camera that uses film with low sensitivity and maintains the shutter of the cameras in an open position. Because the shutter is continuously open, multiple images may be acquired onto the same frame by using a strobing light. In the sunlight, this method can create poor images due to sunlight bleaching the strobed images.

Most preferably, a multishutter system is employed. An example of a multishutter system is the Pulnix TM6705AN camera, which is described in U.S. Pat. No. 6,533,674 and incorporated herein by reference. The Pulnix TM6705AN camera is a square pixel, VGA format, black and white full frame shutter camera. The camera features an electronic shutter that allows the camera to take multiple shutter exposures within a frame to capture high speed events. The camera has a small, lightweight, rugged design, making it ideal for portable systems. In a multishutter system, the camera shutters by activating and deactivating the pixel elements of the CCD sensor. The camera also includes a CCD which may be selectively activated. At desired intervals, the CCD of the camera may be activated and deactivated in order to acquire images on the same frame. A multishutter camera allows multiple images to be acquired in one frame while minimizing the amount of background noise due to ambient lighting.

According to the method of the present invention, a golf club and golf ball are imaged using the apparatus described above. A golf club and ball may be placed in front of the apparatus shown in FIG. 1. In accordance with the present invention, a golf club may be imaged on the upswing or on the downswing, depending on a particular application. In a preferred embodiment, multiple images of the golf club are captured during the downswing.

The swing speed of a club, and thus the velocity of the ball, may vary based on the skill or experience of a player, or the type of club being used. In order to extract useful information about the club and ball, such as that described above, the time interval between captured images may be varied to improve kinematic accuracy. It is desirable to maximize the spectrum of subsequent object images within a given field of view. It also may be necessary to acquire subsequent ball images prior to 360 degrees of ball rotation. Swing speeds may vary between 30 and 130 mph, and ball speeds may vary between 50 and 230 mph. For slower' swing and ball speeds, the time interval between two images is preferably between 1 and 3 milliseconds, and more preferably between 1.5 and 2 milliseconds. For faster swing and ball speeds, the time interval between two images is preferably between 500 and 1000 microseconds, and more preferably between 600 and 800 microseconds. In some embodiments, the difference between the swing speed and the ball speed may be large. In such embodiments, the time interval between two images of the club and the time interval between two images of the ball may be different.

In a preferred embodiment, the camera assembly comprises an imaging sensor and lens assembly, and a camera control board. In one embodiment, the imaging sensor may be a CCD. However, other types of sensors, such as a CMOS sensor, may be used. As shown in the FIG. 1 embodiment, the imaging sensor and lens assembly is preferably attached to the rigid aluminum face of the launch monitor. One advantage of having the imaging sensor and lens assembly fixed to the face of the plate is that the likelihood of the system falling out of calibration due to misalignment or vibration is limited. Monitoring systems which are not rigid require frequent calibration and are less desirable for portable equipment.

The camera control board may be detached from the imaging sensor. In one embodiment, the camera control board may be located at a different location within the housing. The imaging sensor may be attached to the camera control board using, for example, a ribbon cable. Remotely locating the camera control board within the housing of the launch monitor provides the advantage of providing more flexibility in placing components within the housing.

The imaging sensor in a digital camera, such as a CCD or CMOS, is composed of pixels, which are tiny light-sensitive regions. The sensors in most cameras today are made up of millions of pixels, each one registering the brightness of the light striking it as the photo is taken. The number of pixels in the image is referred to as the image's resolution. Previous launch monitors used low resolution camera's in order to capture images. This was partially due to a lack of high resolution cameras, and partially because high resolution images require larger amounts of storage space. As technology has improved, high resolution camera prices and memory prices have dropped. It is now cost effective to use a high resolution camera for many applications.

In a preferred embodiment of the present invention, it is desirable for the resolution of the camera to be sufficient to allow a kinematic analysis of the images. Increasing the resolution of the camera allows a more detailed picture to be taken of a golf club and ball in motion. This in turn provides the advantage of allowing more accurate and precise kinematic calculations. Preferably, the resolution of the camera is about 300,000 pixels or greater, and more preferably is about 600,000 pixels or greater. Even more preferably, the resolution of the camera is about 1,000,000 pixels or greater. In an alternative embodiment, the resolution of the cameral may be capable of a 640×480 size pixel image or greater. More preferably, the resolution of the image of the camera is about 1024×768 or greater.

In another embodiment, the present invention may have four cameras. FIGS. 20A and 20B are diagrams showing one embodiment of a four camera system. As shown in FIGS. 20A and 20B, one embodiment comprises four cameras 2001, 2003 selectively positioned on the face of the launch monitor. Preferably, cameras 2001 are used to acquire images of the golf club and cameras 2003 are used to acquire images of the golf ball.

References to direction or orientation of objects relating to the invention are described herein with respect to the figures provided. Those skilled in the art will recognize, however, that the orientations described herein may vary according to other positions, orientations, or layout of features of the launch monitor. In one embodiment, each of the cameras 2001 may be used to monitor the golf club, and may be selectively positioned on one side of a vertical axis passing through the center of the face of the launch monitor. Preferably, the camera's 2001 that are used to monitor the golf club are positioned near the triggers 2007. In this embodiment, the cameras 2001 are selectively positioned such that they are symmetric about a transverse plane passing through the face. One advantage of positioning the cameras 2001 in this manner is that they may be used to acquire images of both a right handed or left handed golf player when used in the FIG. 20A or 20B configuration, respectively.

In this embodiment, cameras 2003 may also be selectively positioned on the face of the launch monitor. In such an embodiment, each of the cameras 2003 may be used to monitor the golf ball. The cameras 2003 are preferably positioned symmetrically about a transverse plane passing through the face. Symmetrically positioning the cameras 2003 allows the cameras to monitor either a right or left handed golf player. As shown in FIGS. 20A and 20B, the cameras 2003 may be selectively positioned such that a lamp 2005 may be placed in between them. The lamp 2005 is discussed in more detail below.

Figure 21A:
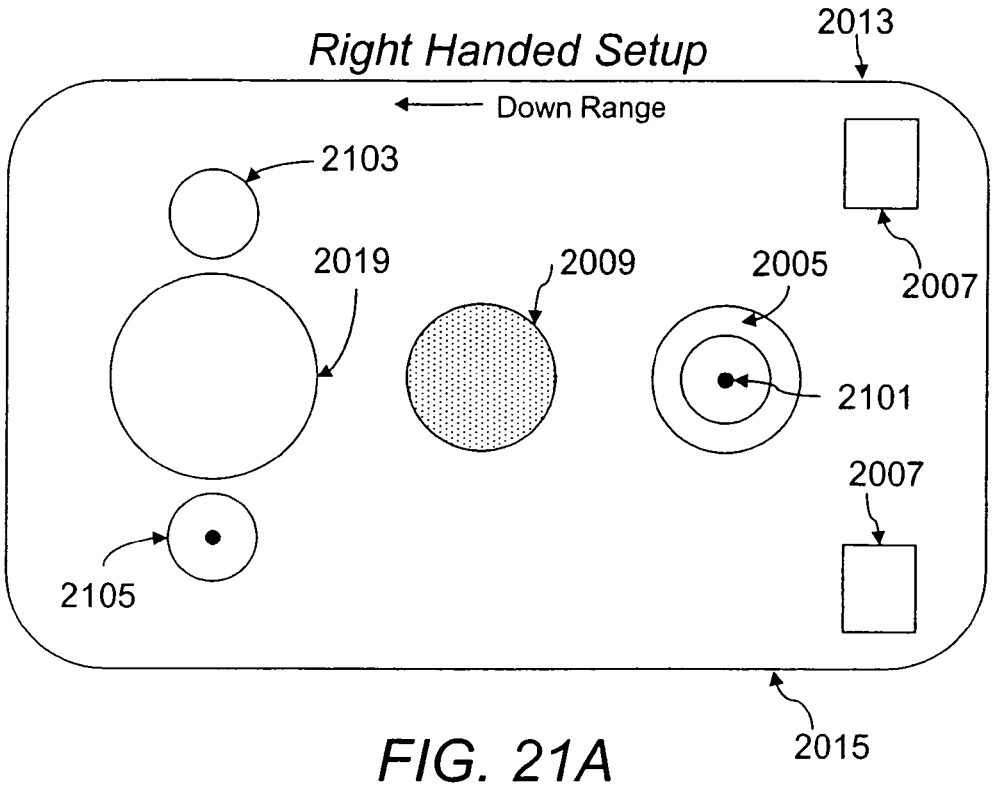
FIGS. 21A and 21B are diagrams showing another embodiment of the face according to the present invention.
Figure 21B:
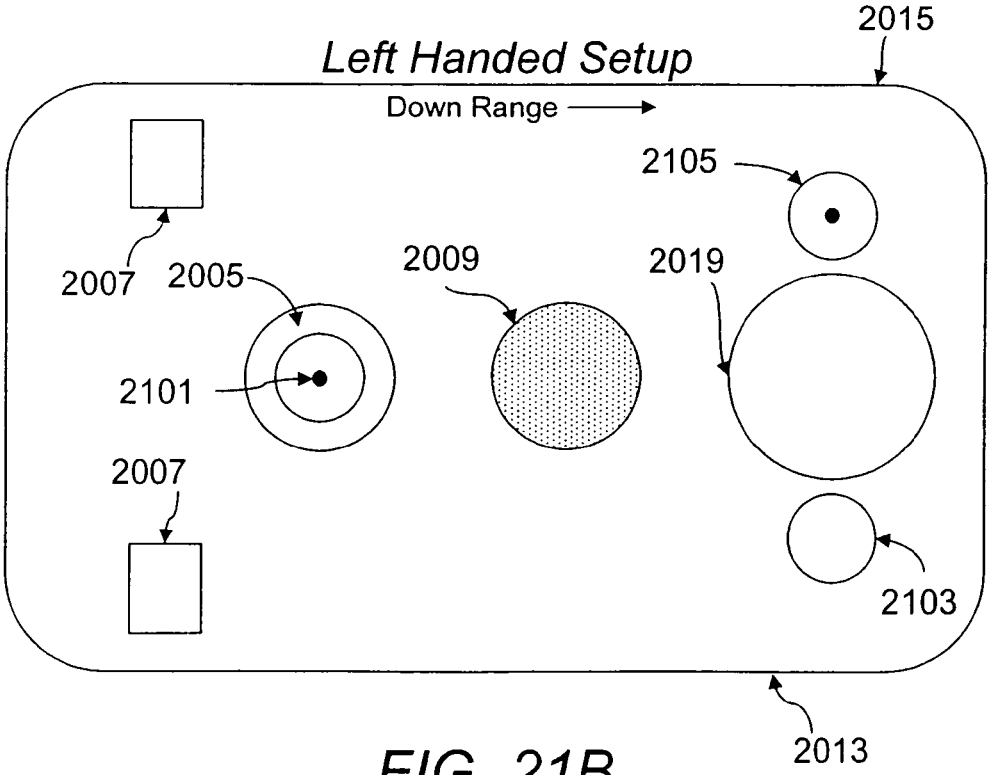

In another embodiment, the present invention comprises three cameras. In such an embodiment, shown in FIGS. 21A and 21B, only one camera 2101 may be used to acquire images of a golf club. The camera 2101 may be selectively positioned such that it is symmetric about a transverse plane passing through the face of the launch monitor. As described above, symmetrically positioning the camera 2101 allows it to acquire images of a golf club for both left and right handed players, as shown in FIGS. 21A and 21B, respectively. In this embodiment, cameras 2103 and 2105 are selectively positioned to acquire images of a golf ball, similar to camera's 2003 (FIGS. 20A-20B), described above. Using three cameras 2101-2105 to monitor golf club and ball trajectory is described in U.S. patent application Ser. No. 10/759,080, entitled "One Camera Club Monitor," the entirety of which is incorporated herein by reference.

In one embodiment, the cameras 2001 that monitor the golf club may be positioned such that the central lines of sight of each of the cameras intersect to form an a predetermined angle. In the FIGS. 20A and 20B embodiments, each of the cameras 2003 that monitor the golf club may be positioned substantially similar to the cameras 2001 that monitor the golf club. It may be desirable to position each set of cameras 2001 and 2003 such that the angle formed by the intersection of the central lines of sight may be divided symmetrically by a transverse plane passing through the center of the face. One advantage of positioning the cameras 2001, 2003 in this manner is that the housing of the launch monitor may be adjusted such that the bottom cameras are substantially parallel to level ground while the top cameras face downwards at a desired angle. For example, the cameras 2001, 2003 may be positioned such that their central lines of sight form an angle of about 10 degrees or greater relative to a horizontal ground plane. By rotating the entire housing of the launch monitor towards the ground by 10 degrees, upper cameras would be oriented downwards by about 20 degrees. As a result, lower cameras would be positioned at about 0 degrees, or parallel to level ground. One advantage of having the cameras positioned in such a manner is that the upper cameras may be focused downwards towards the golf club and ball while the lower cameras would be at substantially the same level as the golf club and ball during impact. This would enable the present invention to acquire images of the golf club and ball from two different perspectives.

Preferably, cameras 2001, 2003 are positioned such that a transverse plane passing through the center of the face of the launch monitor divides the angle formed by the intersection of the central lines of sight of each camera 2001, 2003 symmetrically. One advantage of this orientation is that the images acquired by the cameras 2001, 2003 can be correlated without requiring complex calculations. Preferably, the cameras 2001, 2003 may be positioned such that the angle formed by the intersection of their central lines of sight is about 5 degrees or greater. More preferably, the cameras 2001, 2003 may be positioned such that the angle formed by the intersection of their central lines of sight is about 10 degrees or greater. Most preferably, the cameras 2001, 2003 may be positioned such that the angle formed by the intersection of their central lines of sight is about 15 degrees or greater.

As described above, in one embodiment the present invention may be adjusted to monitor both right and left handed golf players. One advantage of having the camera configuration described above is that the housing of the launch monitor may be rotated about a transverse axis while allowing the cameras to be positioned in a substantially similar manner when monitoring both right and left handed players. In other words, the launch monitor may be rotated about a transverse axis to monitor either right or left handed golf players while allowing the cameras to view the golf club and ball from substantially similar angles.

In the embodiment shown in FIGS. 21A and 21B, camera 2101 is positioned symmetrically about a transverse plane passing through the face of the launch monitor. Preferably, the camera 2101 is capable of acquiring images of a golf club. It is desirable that the camera 2101 is capable of being used for both right and left handed players. Thus, in one embodiment, the camera 2101 may be positioned substantially parallel to level ground. Positioning the camera 2101 in this manner allows the camera to acquire images of the golf club from the same perspective using either of the configurations shown in the FIGS. 21A and 21B embodiment.

Flash

At least one light source is typically present in many prior art launch monitors. The light source is used to illuminate the ball and club in order to generate one or more images. In one embodiment, a light source illuminates the golf club and ball. The light that reflects back from each object is imaged by the camera assembly.

In another embodiment, a club and ball may be tagged using a set of markers. In combination with a camera system, this can be a powerful tool for analyzing the swing of a player. Typically, the markers placed on the equipment are selected to create a high contrast on the images of the swing captured by the camera. In one example, the markers may be black dots on the surface of a white ball. A light source such as a strobe, that is fired at the ball during impact, captures the black dots on a high contrast white background. The use of black dots, however, may not generate sufficient contrast to allow such a system to be used in an outdoor environment.

To increase the contrast of the markers compared to background light, high intensity markers or limited spectrum markers are typically used. High intensity markers reflect light with a higher intensity than a white diffuse surface. Limited spectrum markers are excited by a specific spectrum of light, and only return light within a certain excitation wavelength. In one embodiment, the present invention may be used with either high intensity markers or limited spectrum markers. In another embodiment, a combination of both types of markers may be used. Each type of marker will be discussed in more detail below.

When acquiring images based on limited spectrum markers, it is desirable to have a light source that is able to emit light within a narrow spectrum. This is because each limited spectrum marker is excited by light within a narrow spectrum, as described above. In a preferred embodiment, the light source comprises one or more strobe lamps 121. In this embodiment, the flashes are located behind two fresnel lenses, which are positioned substantially flush with the face and are visible in FIG. 1. A strobe lamp provides the advantage of providing a high intensity flash of light that has a short duration. Additionally, a strobe lamp is capable of generating multiple consecutive flashes of light.

In other embodiments, such as the one shown in FIGS. 20A and 20B, a ring lamp 2005 may be used to illuminate the golf club markers. Preferably, the ring lamp 2005 is selectively positioned around the circumference of the aperture of cameras 2001. The ring lamp 2005 may comprise any type of bulb, for example, LED's or fiber optic light sources. In some embodiments, the ring lamp 2005 may comprise filtered strobes or LED's, or alternately the ring lamp 2005 may include a filter, as described below.

As mentioned above, the ring lamp 2005 may comprise LED's in one embodiment. In such an embodiment, the LED's are preferably capable of generating light with sufficient intensity to illuminate the golf club when it is within the camera's 2001, 2003 field of view. In this embodiment, the number of LED's is preferably about 40 or greater. More preferably, the number of LED's is about 60 or greater, and most preferably the number of LED's is about 100 or greater.

In the FIGS. 20A-20B and 21A-21B embodiments, a second light source 2011 may be included. The second light source 2011 is preferably positioned symmetrically about a longitudinal axis passing through the launch monitor. Positioning the light source 2011 symmetrically about a longitudinal axis allows it to be used for both right and left handed golfers, as shown in FIGS. 20A and 20B, respectively. Preferably, the light source 2011 is selectively positioned between cameras 2003 such that it is capable of illuminating markers positioned on a golf ball. Preferably, the light source 2011 is filtered, as described below.

In one embodiment, the light source 2011 in conjunction with a filter only allows blue light to pass. In one embodiment, this would allow orange or green fluorescent markers to fluoresce, which would allow images of the golf ball to be isolated from images of the golf club. Any type of light source may be used, such as a fiber optic light source, ring light, LED's, and the like. The light source 2011 preferably includes a fresnel lens. The fresnel lens is preferably about 4 inches or greater in diameter. More preferably, the fresnel lens is about 6 inches or greater, and most preferably the fresnel lens is about 8 inches or greater in diameter.

In a preferred embodiment, the strobe lamp preferably includes an integral filter. The integral filter is preferably part of the housing of the strobe lamp. The filter only allows light within a desired spectrum to pass to the golf ball and golf club. Many different types of filters may be used in accordance with the present invention. The type of filter that is employed may depend on environmental factors, the types of markers that are used, or the like.

Preferably, a high quality filter is employed. The filter should be capable of withstanding high temperatures, and should be durable. In addition, the filter should be capable of passing between about 60% and about 90% of the desired wavelength of light. In one embodiment, a dichroic filter may be used to provide these advantages. A dichroic filter is an optical filter that reflects one or more optical bands or wavelengths and transmits others, while maintaining a nearly zero coefficient of absorption for all wavelengths of interest. A dichroic filter may be high-pass, low-pass, band-pass, or band rejection.

In one embodiment, a low pass filter may be used to allow light between desired wavelengths to pass. The wavelength of light that is allowed to pass may depend on the types of markers that are used. In one embodiment, light that is less than 500 nm is allowed to pass through the low pass filter. More preferably, light that is less than 480 nm is allowed to pass, and most preferably light less than 470 nm is allowed to pass.

In one embodiment, the filters are chosen according to the limited spectrum markers that are placed on the surface of the golf ball or club. The wavelength of light that is allowed to pass through the filters is typically referred to as the excitation wavelength, while the wavelength of light that is returned by the limited spectrum markers is typically referred to as the emission wavelength. When the excitation wavelength light reflects off of white surfaces, it is reflected back at substantially the same wavelength. However, when the excitation wavelength light strikes the limited spectrum markers, it is reflected back at a substantially different wavelength that depends on the properties of the markers. In one embodiment, the excitation wavelength is not part of the emission wavelength. This allows a camera system filter to eliminate all light reflected from surfaces other then the markers light reflected from surfaces other than the markers.

Another aspect of a strobe lamp that provides an indication of its intensity is the magnitude of the number of joules of light that are emitted. In one embodiment, this measurement indicates the number of joules of light that are emitted by each flash of a strobe lamp. Preferably, greater than 5 joules are emitted by each strobe lamp. More preferably, greater than 15 joules are emitted, and most preferably greater than 20 are emitted by each strobe lamp.

In one embodiment, it is desirable for the strobe lamp to generate multiple flashes of light within a short period of time. This allows multiple images of both a golf club and ball to be taken before and after impact. Thus, it is desirable to minimize the time required for successive flashes. Preferably, the lag time between successive flashes is less than 1000 microseconds. More preferably, the lag time between flashes is less than 500 microseconds, and most preferably the lag time between flashes is less than 200 microseconds.

In a preferred embodiment, as described above, two or more flashes are generated within a short amount of time. Because the flashes are generated rapidly, it is impossible for a user to distinguish between consecutive flashes. In addition, a user may not know whether both flashes fired correctly because of the short duration of each flash. With previous systems, a user would have to inspect the acquired images and/or the kinematic analysis in order to determine if each of the flashes had fired correctly. Extensive diagnostic time was often required to identify a failure in the flash system.

To enable automated diagnostics, the flash preferably sends a signal to a processing unit when it fires. The signal preferably indicates the duration of each flash and the number of flashes fired. The signal is preferably generated from a photodiode which is integral to the flash assembly. In one embodiment, this information may be displayed on the integrated display. By signaling the processor with information about the duration of each flash, the present invention provides the advantage of allowing the processor to increase the accuracy of the kinematic measurements and subsequent analysis. This is because increasing the accuracy of each parameter, such as the duration of an individual flash and the time between subsequent flashes, will allow a processor to more accurately calculate the kinematic characteristics of the golf club and ball.

In a preferred embodiment, the flash is generated by using one or more xenon bulbs. A xenon bulb provides the advantage of generating a large amount of high intensity white light. In conjunction with a Fresnel lens, the light generated by the xenon bulb is capable of being focused towards a specific area, such as the field of view that was described above. In other embodiments, other types of bulbs that are capable of generating high intensity light, such as LED's, may be used.

Trigger

In one embodiment, it is desirable to capture images of the golf club before impact with the golf ball. Additionally, it is desirable to capture images of the golf ball in the moments after impact. As described above, this allows the kinematic characteristics of the club and ball to be calculated. In order to capture the desired images, the camera and flash must be activated during the desired portions of the swing and the ball trajectory. In rudimentary systems, this was done by manually selecting the opposite times for a player typical swing speed. However, more advanced systems employ a triggering system that determines when the club and ball are in motion, and relays this information to the camera and flash through a signaling system.

Accordingly, the camera and flash are preferably synchronized such that they are capable of generating images of the golf club and golf ball in motion. In order to generate images, the camera and the flash have to be triggered to activate substantially simultaneously. This allows the light generated by the flash to be reflected by the ball or club, and then captured by the camera. Thus, upon detection of club motion, the camera and flash may be triggered to activate.

The configuration, type, and number of triggers may be varied. For instance, in one embodiment, two triggers may be used. The two triggers are selectively positioned such that they require no mechanical intervention regardless of the golfers handedness. In other words, they do not have to be manually or automatically moved, realigned, or readjusted in order to detect motion of a golf club and/or ball for left and right handed golfers.

In one embodiment, one of the triggers may detect the motion of the club while the second trigger determines the motion of the ball, after impact. Either trigger is capable of detecting the motion of the club or ball, and depends on whether a right or left handed player is swinging the club. In a preferred embodiment, two trigger assemblies are used. One trigger assembly preferably detects club motion for right handed golfers and the other trigger assembly detects club motion for left handed golfers. One example of this embodiment is shown in FIG. 1, where triggers 117 and 119 are selectively positioned at opposite sides of the launch monitor. Each trigger is preferably located close to the ground so that it is able to detect the club in motion prior to impact.

In another embodiment, only one trigger assembly may be used. The single trigger is preferably capable of detecting the motion of the club. In this embodiment, the trigger is preferably placed at the center of the launch monitor. Though not shown in FIG. 1, this trigger may be located midway between triggers 117 and 119. The trigger preferably has a rotatable or pivoting connection. This connection allows the trigger to be angled towards the right or left, depending on whether a right or left handed player is swinging a club. The trigger may be moved manually, or in another embodiment, may be moved automatically using a motor or the like.

In another embodiment, shown in FIGS. 20A and 20B, two triggers 2007 may be selectively positioned on one side of the housing. In this embodiment, the triggers 2007 are preferably placed such that they are symmetric about a transverse plane passing through the face of the launch monitor. One advantage of placing the triggers 2007 symmetrically about such a plane is that the triggers may be used to monitor either a right or left handed golf player, as shown in the FIGS. 20A-20B and FIGS. 21A-21B embodiments.

Preferably, the positioning of the triggers 2007 allows a right handed player to be monitored in the FIGS. 20A and 21A embodiments, and a left handed player to be monitored in the FIGS. 20B and 21B embodiments. In the FIGS. 20A-20B and FIGS. 21A-21B embodiments, each trigger 2007 may be capable of detecting the motion of either a golf club or golf ball. It may be desirable, however, for the bottom trigger 2007 to be capable of detecting the motion of the golf club in each of the embodiments.

It is desirable to use a trigger that has a fast response time and high signal to noise ratio. This is desirable because the trigger controls the signaling of the camera and the flash. Thus, the position of the objects reflection within the image frame is dependent on trigger response. In one embodiment, an optically based trigger may be used. An optical trigger has a fast response time and a high signal to noise ratio, is accurate and precise, and is capable of functioning in conditions where ambient light levels are high. This is especially important for a golf monitor that is used outdoors, because the sunlight may interfere with certain types of triggers.

In a preferred embodiment, the optical trigger uses a monochromatic or laser light. One such laser sensor is described by U.S. Pat. No. 6,561,917, which is incorporated herein by reference. In another embodiment, an ultrasonic trigger may be used. One such ultrasonic trigger is described by pending U.S. patent application Ser. No. 10/667,479, entitled "Golf Club and Ball Performance Monitor Having An Ultrasonic Trigger," which is incorporated herein in its entirety.

Trigger's commonly include an emitter and receiver. As described above, it is desirable for the present invention to comprise substantially all of the functional components within the housing of the launch monitor. Accordingly, the emitter and receiver are preferably housed within the present invention. As shown in the FIG. 1 embodiment, the trigger assemblies 117 and 119 comprise emitters and receivers. In some embodiments, the trigger may employ a passive reflector that further enhances signal to noise ratio which makes it robust in bright ambient light environments.

In order to control the activation of the camera and the flashes, the trigger preferably includes a control circuit. In one embodiment, the control circuit preferably includes a discrete logic device such as a field programmable gate array (FPGA), microprocessor, or digital signal processor. The discrete logic device allows the trigger to be reprogrammed, as will be described in more detail below. Because the trigger is being used with objects that are moving at a high velocity, it is preferable that the trigger is capable of performing real time control of the camera's and flashes.

In a preferred embodiment, the trigger determines the timing of the activation of the camera and flashes based on a lookup table. The lookup table is preferably stored in a memory, or a device that includes a memory, such as an FPGA. Preferably, the lookup table is capable of storing 10 or more categories of data. More preferably, the lookup table is capable of storing 25 or more categories of data, and most preferably the lookup table is capable of storing 50 or more categories of data.

Among the categories of data that may be stored are various time intervals for the activation of cameras and flashes. The category which should be used for a particular swing is determined by the trigger interval. In one embodiment, the trigger interval is determined by the duration which a club is detected by the trigger sensor. In a preferred embodiment, the trigger interval is determined by the duration between two sequential club detection locations. In a preferred embodiment, the trigger determines the time interval that it takes for the object to move from one predetermined point to another. The triggering circuit then uses the lookup table to determine the appropriate timing for the cameras and flashes.

FIG. 2 is a table showing an exemplary lookup table structure employed by an FPGA algorithm. The table illustrates one exemplary embodiment of an FPGA which uses, for example, a 10 MHz clock In one embodiment, the present invention employs two laser beams with a spacing of, for example, 0.875", to detect club motion. The exemplary lookup table may be used to control when cameras shutters are opened and closed, and when a strobe light is applied to the scene. One advantage of this embodiment is that images of the club and ball are acquired while these objects are within the camera's field of view. Additionally, the laser beams allow the amount of time the cameras shutter is open to be minimized, improving image quality by minimizing ambient light. The table shown in FIG. 2 is preferably configured to acquire club images at distances of, for example, approximately 4 and 7.5 inches from the first laser position and ball images at, for example, approximately 7.5 and 11 inches from the first laser position.

In one embodiment, the present invention operates as described below. A counter is preferably started within the FPGA when the laser associated with the first trigger is interrupted by the club. A row within the lookup table stored within the FPGA is then selected based on the count value when the laser associated with the second trigger is interrupted by the club.

The cameras and strobes are then controlled based on the timing associated with the selected row. For example, if the count value is 8000 when the second laser is interrupted by the club, then row 9 will be selected for execution. The selection of row 9 is dictated by FPGA program logistics, since the count value of 8000 is greater than or equal to 7574, row 9's count value, and less than 8248, row 8's count value. Thus, a selection of row 9 is specified for execution. With row 9 selected, the club cameras will open when the count reaches 34525, strobes will initiate at counts of 34626 and 64923. Then, the club camera will close at count 65123, the ball camera will open at 91727, the strobe will illuminate at counts 91827 and 103605, and then finally ball camera will close at 103805.

The 20 row FPGA table illustrated in FIG. 2 may be employed to effectively capture images of club and ball collisions where the club speed varies over a wide range. The 20 rows employed in the table shown in FIG. 2 are capable of capturing images with club speeds from, for example, 30 to 150 mph. In other embodiments, alternate tables with additional rows for finer spatial resolution of subsequent images may be employed. It may also be desirable to expand the speed range to a broader or narrower range than the 30-150 mph range associated with the table shown in FIG. 2.

CPU

Figure 3:
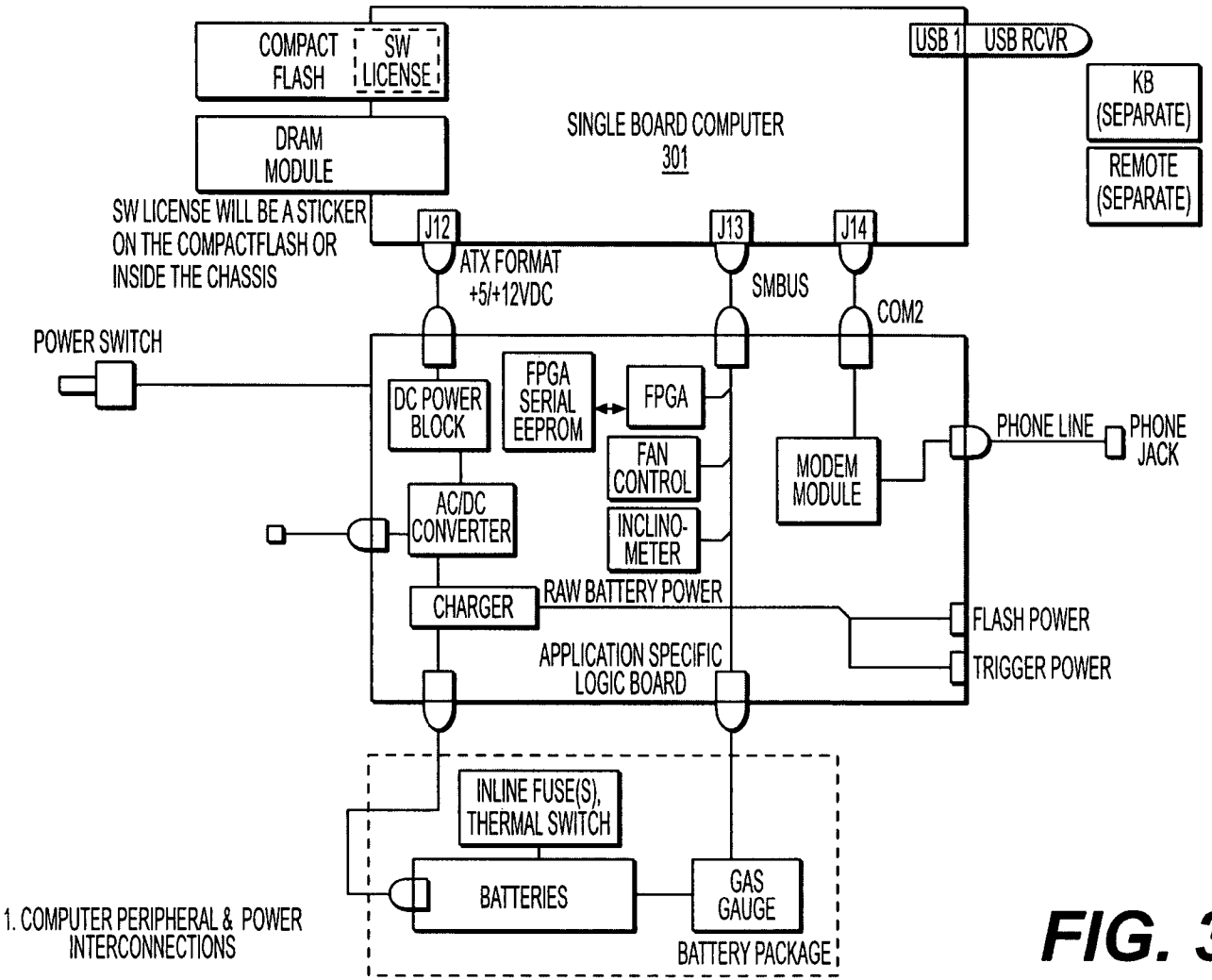
FIGS. 3-7 are block diagrams that illustrate the major functional components in one embodiment of the present invention.
Figure 4:
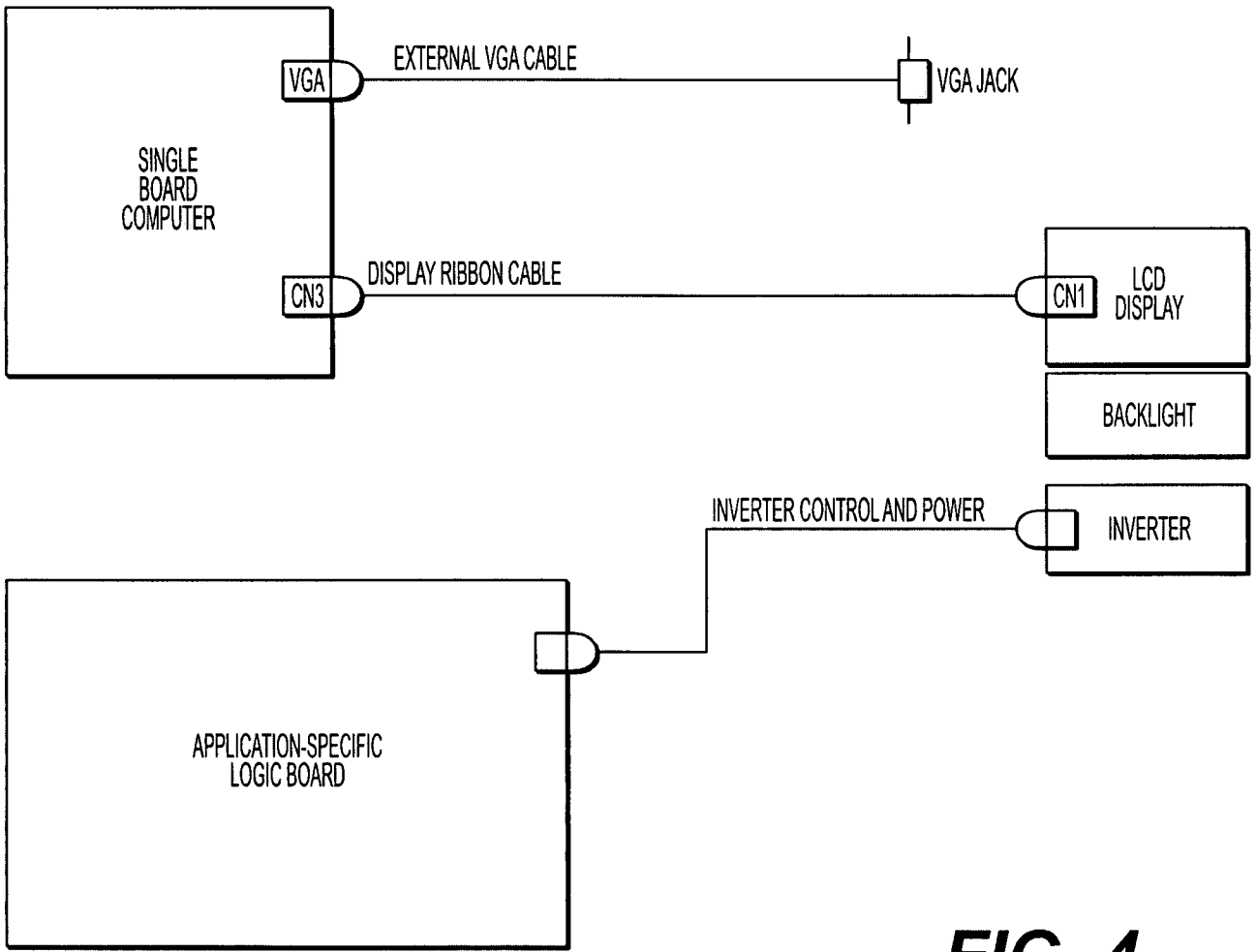
Figure 5:
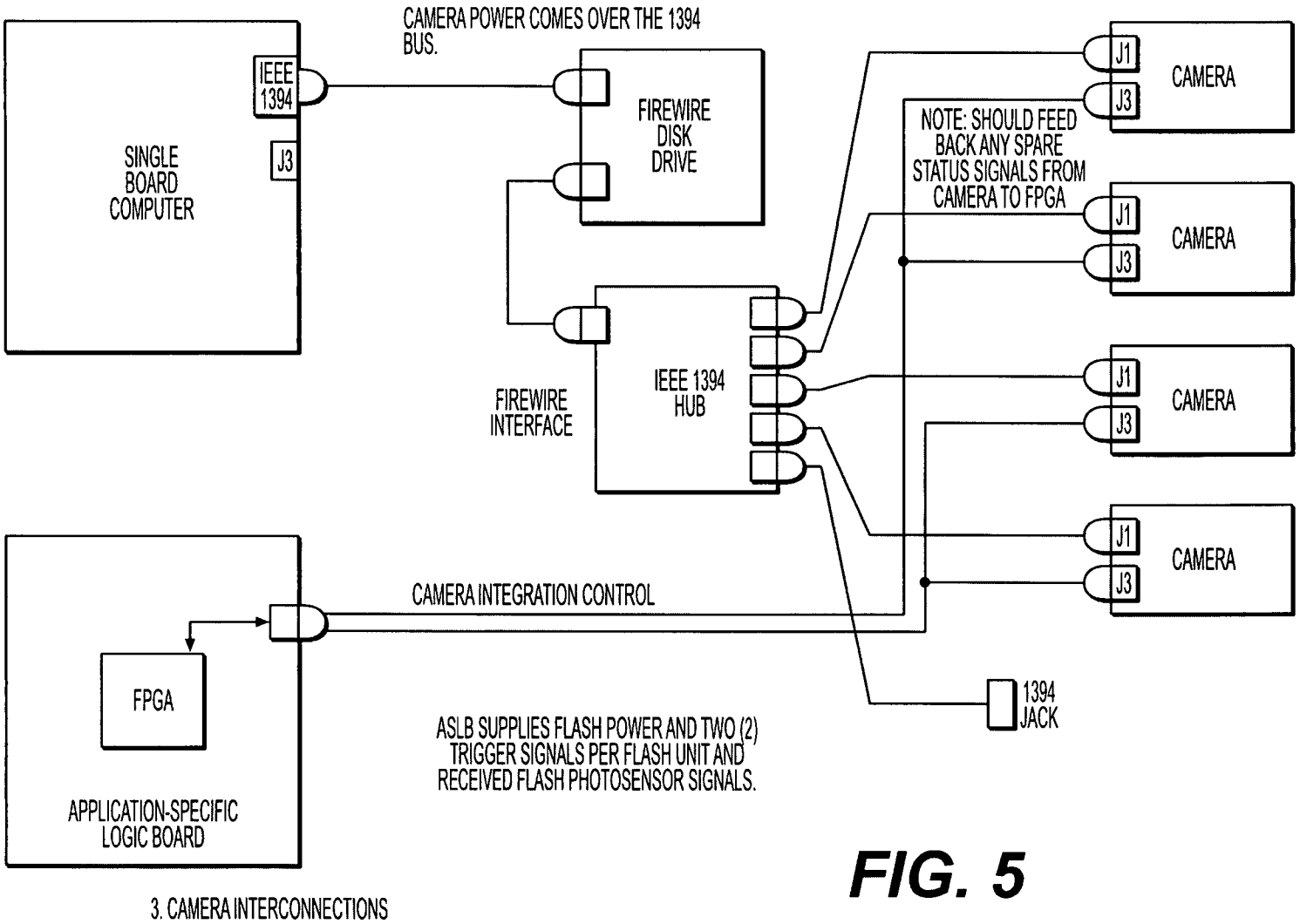
Figure 6:
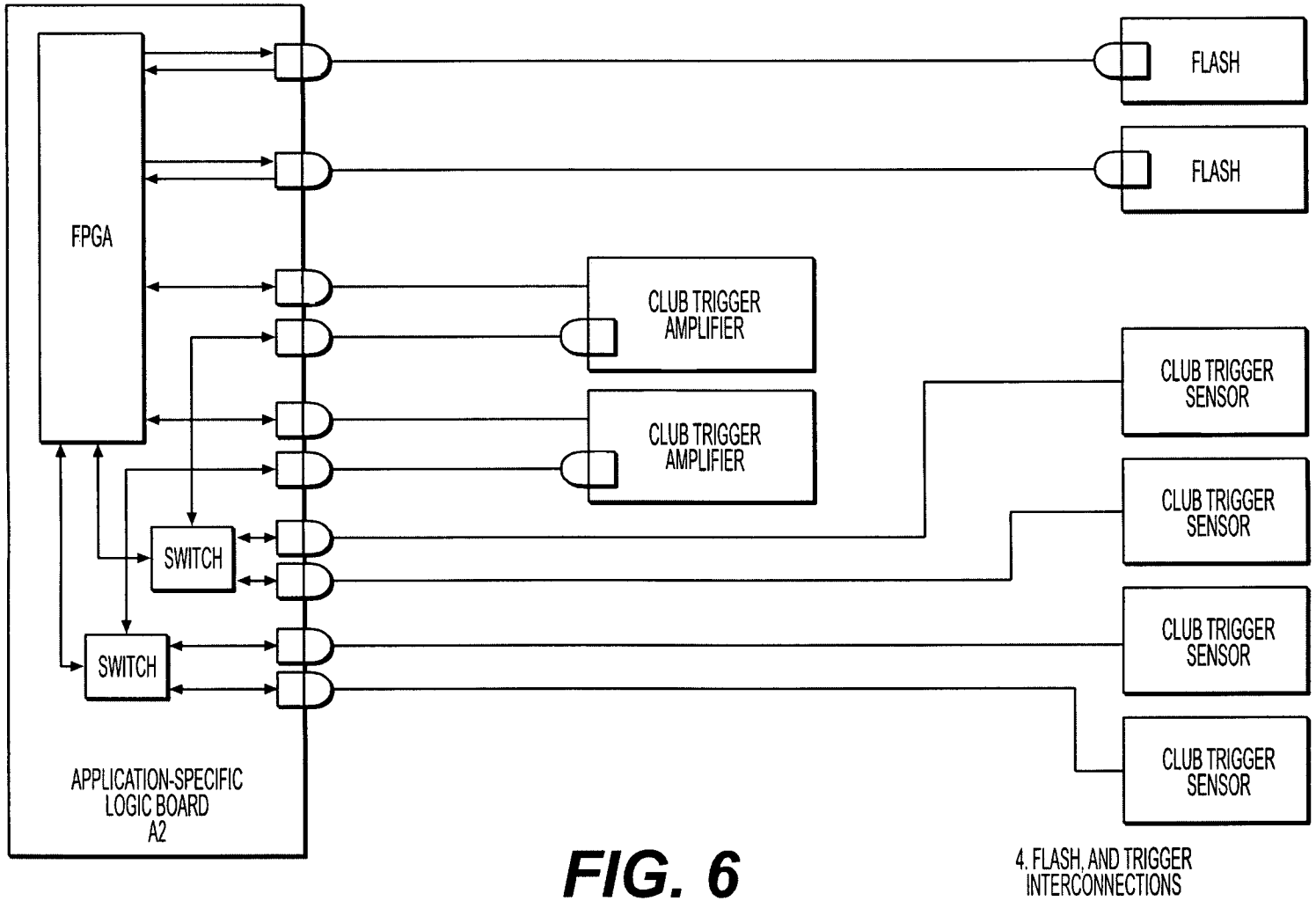
Figure 7:
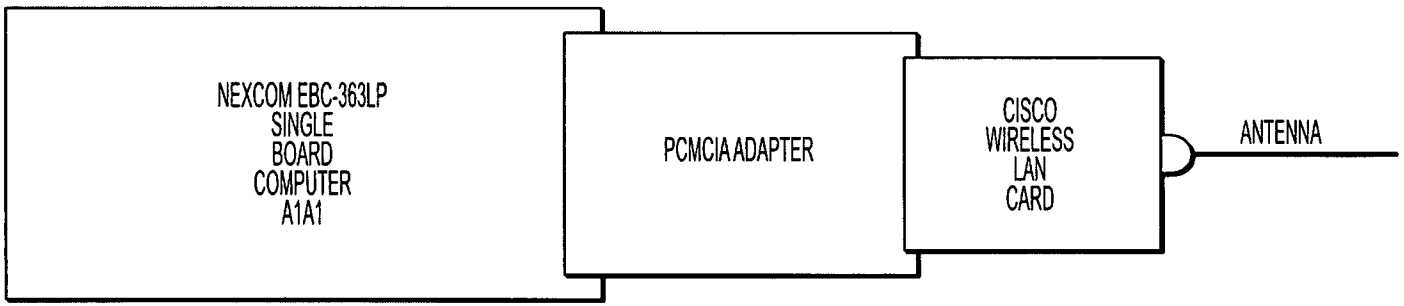

As described with respect to various aspects of the present invention, a processor is preferably included. In one embodiment, the processor may be a single board computer 301, as shown in FIG. 3. FIGS. 3-7 are block diagrams that illustrate the major functional components in one embodiment of the present invention. The processor may be used to instruct the various functional components. In a preferred embodiment, the processor is used to perform analysis and display results. The processor preferably uses an embedded operating system. This includes, but is not limited to, Microsoft Windows XP or Microsoft Windows CE.

These processing systems are preferred because they are robust. In other words, relative to other available operating systems, they have been thoroughly tested for bugs and are relatively immune to frequent system crashes. These operating system provide the additional advantage of having a short startup time. Though even a slow operating system does not require more than minutes to startup, a long startup time in addition to other setup requirements eventually becomes time consuming and even burdensome. Thus, it is desirable to use such operating systems in order to minimize the startup time.

In a preferred embodiment, the processor is capable of performing a variety of functions. For example, the processor is capable of processing the acquired images and sending them to a memory. Additionally, the processor executes the software that is necessary to analyze the images. The processor is capable of performing any function known to those skilled in the art.

For example, in one embodiment, the processor may also be capable of controlling the communications equipment that is necessary for wireless communication with a laptop, central database, or server. The processor preferably uses one of the wireless protocol's that are available. Preferably, the 802.11a protocol is used. More preferably, the 802.11b protocol is used, and most preferably the 802.11g protocol is used. The desired protocol may be based on the desired data transfer rate, the distance that the data will be transferred, or other parameters known to those skilled in the art. In one embodiment, the data rates may be greater than about 1 Mbps. In another embodiment, the data rates may be greater than about 10 Mbps. In yet another embodiment, the data rate may be greater than about 50 Mbps.

As described above, it is desirable to have the results of the kinematic analysis displayed on the integrated display. The operating systems described above allow the processing unit to minimize the time between the ball impact and the display of the kinematic analysis. Preferably, the time between the ball impact and the display of kinematic results is less than about 6 seconds. More preferably, the time between the ball impact and the display is less than about 3 seconds. Most preferably, the time between the ball impact and the display is less than about 1 second.

Display

The location of the integrated display, and its use, was described above. The display may be chosen based on a variety of factors. It is desirable to have a display that is clear, bright, and large enough to see. Many types of displays are currently available. In one embodiment, an OLED screen may be used. In another embodiment, an LCD, TFT, or the like may be used. It is desirable to have a color display. The color display provides the user with an attractive screen that is easy to read. In addition, a color screen enables color coding any information that is displayed on the screen.

It is desirable that the size of the screen is large enough so that a player can distinguish its contents. Preferably the size of the screen, measured diagonally, is about 10" or greater. More preferably, the size of the screen is about 13" or greater, and most preferably the size of the screen is about 15" or greater.

The screen is preferably bright enough so that it can be easily viewed outdoors. The desired brightness depends on many factors, such as the ambient light level. In one embodiment, the brightness of the screen is greater than 250 nit or greater. In another embodiment, the brightness of the screen is greater than 400 nit or greater. In yet another embodiment, the brightness of the screen is greater than 600 nit or greater. In some situations, where the ambient light level is extremely high, a screen brightness of 800 nit or greater may be desirable in order to see the display.

In one embodiment, the screen brightness may be manually adjusted to provide the minimum required brightness, thereby conserving energy and extending the operating time during battery powered operation. In a preferred embodiment, a photo detector sense ambient light and automatically selects the minimum brightness required, thereby conserving energy and extending operating time during the battery powered operation.

In some situations, where ambient light intensity is very high, it may be desirable to use a screen with an anti-reflective coating. Any anti-reflective screen known to those skilled in the art may be used. Some screens prevent reflecting by using a rough, but substantially transparent surface. Other screens employ a coating that minimizes the amount of light that reflects from its surface. The type of screen that is used may depend on its aesthetic qualities, cost, or the like. In a preferred embodiment, the screen may be trans-reflective. A trans-reflective screen allows light to pass through the display, reflect off a mirror, and then travel back out. This type of screen allows for enhanced viewing in outdoor environments while consuming less energy, thereby extending operating time while under battery power.

In one embodiment, it may be desirable to have a touch sensitive screen. A touch sensitive screen allows a player to use the integrated display in an interactive manner. Any touch screen known to those skilled in the art may be used. In embodiments with a touch screen, a remote may not be needed. However, it may be optionally included, or alternately it may have limited functions.

Optical Fingerprinting

When a player is using the launch monitor of the present invention, it is desirable to minimize the manual inputs that are necessary for the monitor to function. A time consuming and burdensome task that is associated with the use of launch monitor's is the entry of the type of club and ball that are being used by a player. Previous launch monitor's often require a technician to input the type of ball and club that are being used every time a player swings, which often leads to significant downtime and allows for human errors. Thus, it is desirable to have the launch monitor automatically recognize and identify each ball and club that is being used. Such an automatic recognition and identification system is described in pending U.S. patent application Ser. No. 10/667,478, entitled "Golf Club and Ball Performance Monitor With Automatic Pattern Recognition," the entirety of which is incorporated herein.

In one embodiment, the present invention is able to recognize a plurality of golf clubs and balls based on a database. In such an embodiment, the present invention recognizes an image pattern comparison of a golf club or ball. Then, using the three principal moments of the pattern of markers on the club or ball, the three moments are matched to an existing list of moments in the database that correspond to a particular pattern. A plurality of metrics like the principle moments of golf clubs and balls may be stored in a database in order to allow the present invention to recognize which club and ball a player has chosen.

In one embodiment, the database comprises a plurality of stored reference metrics which may be used to "fingerprint" golf clubs or golf balls. Preferably, the number of stored reference metrics is about 200 or greater. More preferably, the number of reference metrics is about 500 or greater, and most preferably the number of reference metrics is about 1000 or greater.

In one embodiment, the present invention includes a passive radio frequency identification (RFID) system to identify golf equipment. The RFID system preferably includes a passive RFID tag which may be embedded in golf equipment. The RFID tag may include encrypted or non-encrypted bits of data. The data, such as serial number and the like, may be used to uniquely identify a desired piece of golf equipment. The RFID system may also include a reader capable of wireless communication with the RFID tag. In this embodiment, a computer server and/or database management system is preferably included within the housing. The server or database management system preferably verifies the identity of a particular piece of equipment based on a known equipment information database. In other embodiments, the RFID tag and reader may be used to identify golf bags, golf shoes, golf ball boxes, and golf ball pallets. Additionally, the RFID technology may be used to assist in tracking sales and location of these products.

In another embodiment, the present invention may recognize one or more clubs based on Radio Frequency Identification (RFID). RFID technology is well known to those skilled in the art, and is described in BARRON'S (The DOW JONES BUSINESS AND FINANCIAL WEEKLY), May 31, 2004, page 31. RFID technology typically involves a RFID chip or tag, which is placed on the golf club. Any type of RFID chip may be used, such as inductively coupled, capacitively coupled, and the like. The RFID chip typically includes a microprocessor and an antenna that are capable of storing and transmitting information specific to a particular club. A "reader" is then able to communicate with the RFID chip to obtain information about the club to which it is attached. In one embodiment, the reader comprises both a transmitter and receiver. The transmitter and receiver may comprise one element, or alternately they may comprise two operatively connected elements.

RFID technology typically uses either passive or active RFID tags. Both passive and active tags use radio frequency energy to communicate between a tag and a reader. However, the method of powering the tags is different. Active RFID tags use an internal power source within the tag to continuously power the tag and its RF communication circuitry. This can increase the cost and size of the chip. On the other hand, passive RFID tags rely on the RF energy transferred from the reader to power the tag. This allows the tag to be less expensive and bulky.

In one embodiment, the housing of the launch monitor may include a RFID reader that is capable of communicating with the RFID tag. The RFID reader is preferably capable of communicating with the RFID tag to obtain identifying information about the piece of golf equipment to which it is attached, as described below. The RFID tag and reader are preferably able to communicate with each other within a desired range. In some embodiments, it may be desirable to limit the range of the RFID reader so that only clubs that are positioned in front of the launch monitor will be detected and identified. Preferably, this range is about 1 foot or greater. More preferably, the range is about 2 feet or greater, and most preferably the range is about 4 feet or greater.

In one embodiment, the passive RFID tag comprises a microchip with a coiled antenna. Preferably, the reader sends an electromagnetic signal, which is detected by the passive tag. The passive RFID tag in the golf equipment uses the energy of the electromagnetic signal via electromagnetic coupling (backscatter) to transmit its serial number and other desired encrypted or non-encrypted information back to the transceiver. In one embodiment, the information may include the identity of the club and gives the file name relating the markers on the club to the club's sweet spot location. This information is needed to determine hit location and speed at the clubface center when photographic analysis of the swing event is performed.

In one embodiment, the RFID tag may be placed in any desired location on a golf club. However, it may be desirable to place the tag away from portion of the golf club that are capable of functioning as conductors. This is due to the fact that conductors present in a golf club may generate electric and magnetic fields in response to the presence of electromagnetic energy. Thus, to avoid interference with the antenna included in the tag, it may be desirable to place the tag in an area of the club that is isolated from those conducting materials. The non-conducting surfaces of the golf club may include, for example, the undersurface on the grip end of the golf club, the plastic head of the golf club, the graphite shaft, the golf grip, between grip and golf shaft or club head, and the like.

In another embodiment, the RFID tag may be placed within a golf ball during the manufacturing process. The use of RFID tags embedded in golf balls is described in U.S. Patent Application No. 2002/0177490 by Yong, which is incorporated herein by reference. In this embodiment, the RFID tag may be manufactured into the golf ball to allow the reader to identify a ball that is being tested. Alternately, the RFID tag may be used to trigger the camera to acquire images of the golf ball when the processor within the housing determines that the RFID tag has left the golf tee. When the golf ball is positioned on the tee, the RFID reader receives a signal from the RFID tag that has a given signal strength, as described below. In one embodiment, the RFID reader is able to determine when the ball leaves the tee because of the signal strength received from the RFID tag will decrease as it moves away from the tee. When the reader determines that the golf ball is moving away from the tee, the processor may signal the cameras to acquire images.

Preferably, the reader communicates with the tag at a predetermined interval. Preferably, the ball or club contains a one-bit tag that can store only one bit of information i.e. only two states may be represented: the transponder in the ball on the tee or not on the tee. This will shorten the interrogation time so that the ball may be imaged earlier after impact than if we read many bits of information. This will greatly shorten the time between the first image taken of the ball off the tee, which is preferably around one millisecond after impact. Furthermore, the signal strength of RF signals falls off inversely to distance and is further degraded by reflecting off of metal club heads. When the clubhead impacts the ball, the RF field sent out by the tag will be disrupted and break the reception chain. This event will trigger the camera to take an image of the flight scene.

Preferably, the reader communicates with the tag at an interval of about 10 microseconds or less. More preferably, the reader communicates with the tag at an interval of about 5 microseconds or less. Most preferably the reader communicates with the tag at an interval of about 1 microsecond or less.

Alternately, the RFID tag may be embedded in portions of the golf equipment. For example, in one embodiment the RFID tag may be included in golf equipment during the manufacturing process. In this embodiment, the tag may be manufactured into any part of the club or ball. It may be desirable to place the RFID tag in a portion of the club that comprises a substantially small amount of conducting material, such as metals and the like. A conducting material may act as an antenna, which can interfere with the antenna included in the RFID tag. Thus, one advantage of placing the RFID tag away from conducing materials is that interference from those metallic materials may be reduced. For example, in one embodiment the RFID tag may be included in a portion of the head that comprises a composite material. In another embodiment, the RFID tag may be included in the grip, which typically does not include conducting materials. In other embodiments, the tag may be included in a portion of the head, shaft, or grip or a golf club.

In another embodiment, the RFID chip may be attached to a portion of the club after the manufacturing process. In this embodiment, the RFID chip may be attached to any portion of the club that does not come into contact with a player or the ball during the normal course of play. For example, in one embodiment the RFID chip may be attached to a portion of the head that does not come into contact with the golf ball. In other embodiments, the chip may be attached to a portion of the shaft. In some embodiments, the RFID chip may be capable of triggering the camera to acquire an image while the golf club is in motion. This may occur, for example, when the RFID chip is positioned in the toe of club and sensed by the RFID reader.

FIG. 22 is a diagram showing a detailed pictorial description of the operating principles of a reader 4 and the passive RFID tag 3 in one embodiment of the present invention. In one embodiment, the reader 4 transmits an electromagnetic signal with power P1 to the tag 3. The tag 3 electromagnetically couples by resonance to the arriving signal, and uses the energy of this arriving signal to do work. The arriving signal has a reduced power P1* due to attenuation and scattering. The tag 3 responds to the arriving signal and its power by transmitting a serial number with a further reduced power P2* back to the reader 4. The tags signal arrives at the reader with a power P2. Due to attenuation and scattering, the power P2** is further reduced, and hence the communication between the reader 4 and the tag 3 is preferably sufficient to allow communication between the reader 4 and the tag 3**.

In one embodiment, the tag 3 comprises a unique identifier which may be transmitted to the reader 4. After receiving the unique identifier, a processor compares the received identifier with identifiers stored in a database. In some embodiments, the present invention may be capable of identifying more than one golf object substantially simultaneously. This may be desirable, for example, when both a golf club and golf ball include RFID tags. Preferably, the RFID reader is capable of communicating with both the golf club and the golf ball. In other embodiments, a golfers shoes or gloves may also include an RFID tag, which may also be identified by the RFID reader substantially simultaneously.

When the kinematic analysis of the club and ball are performed, an analysis of the properties of each object are also performed. After performing a kinematic analysis of several different clubs and balls, the present invention is capable of determining which properties, such as shaft stiffness or length, provide a player with the best opportunity for success. Additionally, a player can determine which combination of ball and club allow them to have the best swing and resultant ball trajectory. In order to perform such an analysis, the database includes two or more of the properties of each club and ball. These properties may be input manually, or transferred to the processing unit of the present invention from another computing device.

Figure 8:
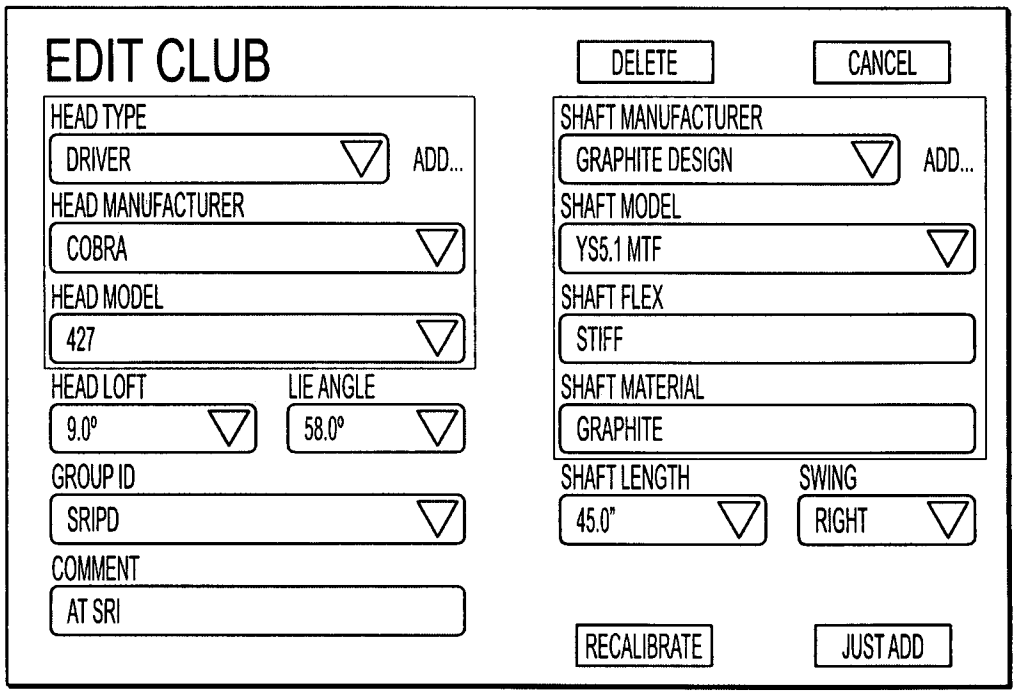
FIG. 8 is a diagram showing an exemplary display on the user interface.

A plurality of properties of each object may be stored in the database. A display on the user interface, shown in FIG. 8, allows an operator to store the name and properties of the club or ball in the database. This may be repeated for a plurality of clubs or balls. Once all of the properties of the clubs are stored into the database, they may be displayed in another exemplary display, shown in FIG. 9.

Figure 9:
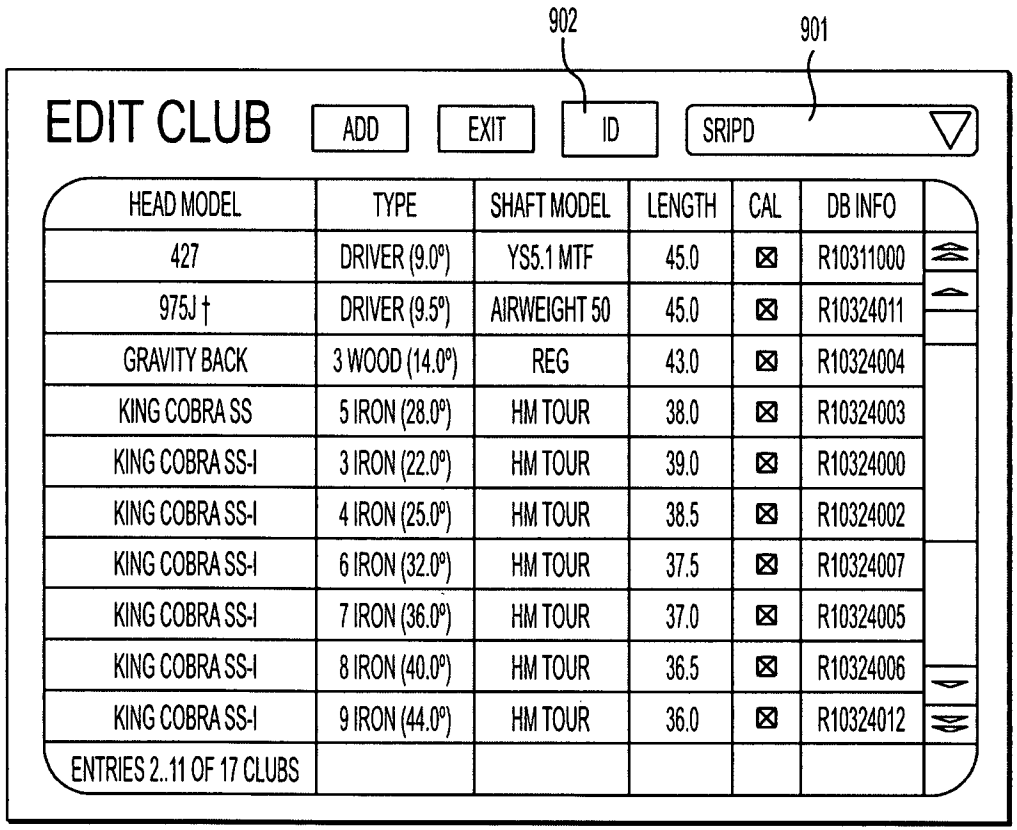
FIG. 9 is a diagram showing another exemplary display on the user interface.

The clubs listed in the FIG. 9 embodiment, may be sorted according to predetermined groups. These groups may be determined in any desired manner, for example, according to the manufacturer, type of club, length of the shaft, or the like. A desired group may be chosen by, for example, selecting a group from a drop down menu 901. A particular club or ball may be identified using the FIG. 9 display by placing the club or ball within the field of view, and selecting the add function 902. Other functions, may be added based on a particular application. For example, it may be desirable to add a function that identifies both the club and the ball substantially simultaneously.

The club properties that may be stored include, but are not limited to, the coefficient of restitution (COR), shaft model, shaft length, shaft stiffness, and the like. Other shaft properties, such as the flex, model, materials, and the like may also be included. In some applications, the loft and lie angle of the clubhead may be particularly important. In other embodiments, the type, manufacturer, head model, and the like may be included in the database. In order to provide useful information to a user on the graphical interface, top, face, and side images of the clubhead may be included as well. The properties of each club that are included in the database are not intended to be limited and may depend on the type of analysis that is desired.

A plurality of properties for each ball may also be stored in the database. These properties may include, but are not limited to, manufacturer, model, weight, diameter, inertia, aerodynamic coefficients, images of the ball, and the like. Other properties may also be included. For example, the database entry for a ball may include the manufacturer and model, inner core diameter, casing diameter, shore D hardness of the cover, and number of types of dimples. One example of such a database for the Titleist ProV1 ball would read: "Titleist ProV1, 1.550", 1.620", 45D, 4."

Teeing Aid

The present invention includes a field of view, as described above. The ball must be placed and impacted within that field of view so that the kinematic analysis may be performed. Prior art launch monitor's have relied on crude methods of verifying that the ball is within the field of view. For example, previous monitors have required a user to align a ball within what they estimate to be the field of view. Alternately, a user would have to wait for an image to be developed to ensure that they struck the ball within the field of view.

Figure 10:
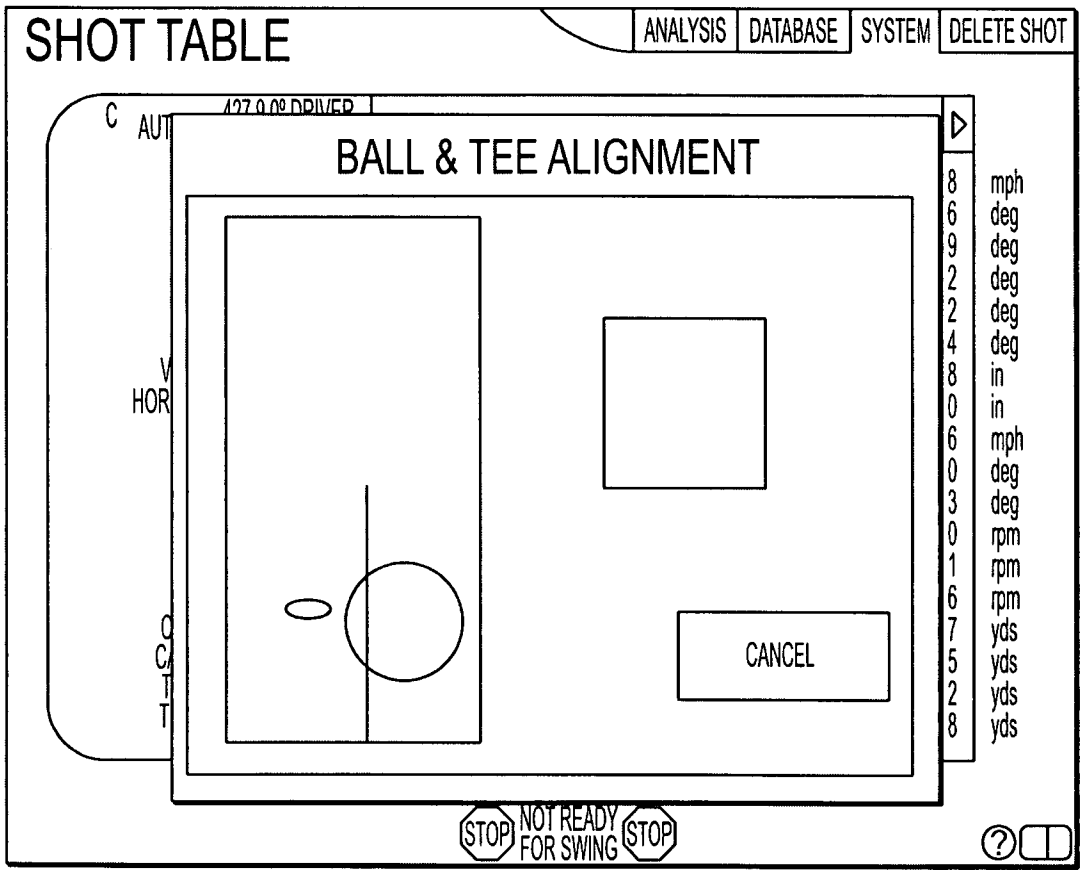
FIG. 10 is a diagram showing one example of a teeing aid displayed on an integrated display.

However, the present invention provides a teeing aid in order to assist a player in verifying that a ball is placed within the field of view of the one or more cameras. The teeing aid preferably displays live video of the field of view on the integrated display, thereby providing the user real time feedback to assist in ball placement. One example of a teeing aid displayed on the integrated display is shown in FIG. 10. As shown in the diagram, the teeing aid provides live video of the teeing area, and has an indicator 1001 that allows a user to determine when a ball is properly positioned within the field of view.

In one embodiment, shown in FIGS. 20A and 20B, the teeing aid may be selectively positioned to be substantially in the center of the face of the launch monitor. The teeing aid 2009 is preferably positioned symmetrically about a transverse plane passing through the face of the launch monitor. One advantage of positioning the teeing aid in the center of the face and symmetrically about a transverse plane is that it is capable of monitoring the teeing position of a golf ball when it is used in both the right and left handed configurations, as shown by FIGS. 20A-20B and FIGS. 21A-21B.

In one embodiment, the teeing aid comprises a predetermined field of view. The field of view may be a substantially square grid. In this embodiment, the square grid may include a plurality of smaller squares. Each of the smaller squares are preferably equal to about one ball diameter. In this embodiment, the teeing aid is able to measure the existing ball location based on the plurality of smaller squares. The teeing aid may then instruct a user to move the golf ball downrange, uprange, towards the golfer, or away from the golfer by a certain distance, for example, inches. In other embodiments, the field of view may be any shape including, but not limited to, circular, triangular, hexagonal, and the like.

In one embodiment, the ball is illuminated by LED light to enhance live video quality. As described before, each ball has a plurality of limited spectrum markers on its surface. In one embodiment, the limited spectrum markers are fluorescent markers, which are responsive to light with a certain wavelength. The LED's generate light that is within the excitation wavelength of the fluorescent markers. The light that is emitted by the golf ball then passes through the camera filter and is acquired by the camera. This image is then displayed on the integrated display. In a preferred embodiment, the video display of the ball includes cross hairs on the display that show the orientation of the ball relative to the field of view. This further assists a player to correctly place the ball in the center of the field of view.

In a preferred embodiment, a cluster of blue LED's located at the center of the launch monitor illuminate the region where the ball should be placed. It is desirable to have enough LED's in the cluster such that the markers of the ball are illuminated with sufficient intensity to be excited and return light within the emission wavelength. Preferably, the cluster of LED's comprises 15 or more LED's. More preferably, the cluster of LED's comprises 30 or more LED's, and most preferably the cluster of LED's comprises 45 or more LED's.

In one embodiment, the video display is generated by increasing the frame rate of the cameras 115. The faster frame rate provides the player with a real time display of the field of view. Depending on the camera and the frame rate, the video image may have a slight delay. Preferably, the video rate of the camera in video mode is about 5 or greater frames per second (fps). More preferably, the video rate is about 10 or greater fps, and most preferably the video rate is about 20 or greater fps. As the rate, measured in frames per second increases, the delay of the display decreases.

In one embodiment, the teeing aid is able to function in three different modes. Each of the three modes allow a different level of assistance. In one mode, referred to as the casual mode, the teeing aid gives a player a predetermined amount of time for the player to place the ball within the field of view. During this time, the video does not come on. If the player has placed the ball correctly within the field of view, no video will be displayed. However, after a short amount of time, preferably about 10 seconds, the video mode will be activated if the ball is not correctly aligned within the field of view.

In a second mode, referred to as the insistent mode, the video mode automatically initiates after each swing and automatically shuts off when a ball is properly located. The third exemplary mode is referred to as the shut off mode. In this mode, the teeing aid is disabled. This mode may be desirable, for example, when a player is using a hitting matt with a fixed tee position, eliminating any need for teeing assistance.

The teeing aid is also capable of determining the distance between the trigger and the placement of the ball. The distance between the trigger and the ball should be calculated because the strobe and camera activation intervals needs to be adjusted according to that distance.

Previous systems required the distance between the ball and the trigger to be known within a tight tolerance, for example, within 1". However, the present invention is able to use the teeing aid to determine the distance between the trigger and the ball. This allows for increased flexibility in where the ball may be placed within the field of view. Once the distance between the ball and the trigger is determined with the teeing aid, the triggering circuit can use a lookup table, described above, to adjust the time of the activation of the cameras and flashes. In one embodiment, the distance between the ball and the trigger should be calculated to within plus or minus 1". In another embodiment, the distance between the ball and the trigger should be calculated to within plus or minus ½".

Accuracy

The swing speed of a club, and thus the velocity of the ball, may vary based on the skill or experience of a player, or the type of club being used. Swing speeds may vary between 30 and 150 mph, and ball speeds may vary between 30 and 225 mph. When fitting low handicap golfers with a driver, variations in speed of 2 mph, variations in spin of 150 rpm, and variations in angle of 0.5 degrees lead to appreciable performance variation. Thus, when attempting to calculate kinematics of objects moving at such a high velocity, it is important that accurate spatial and time information is obtained Imaging system resolution is dependent on imaging sensor resolution and size, as well as lens and filter characteristics. In one embodiment, resolution of the imaging system is preferably greater than 0.5 line pairs per millimeter (lp/mm). More preferably, image resolution is greater than 1 lp/mm. Most preferably image resolution is greater than 5 lp/mm. The image resolution may be measured using a USAF target available from Edmund Industrial Optics.

In one embodiment, the estimated time between subsequent images is accurate to within 10 microseconds. In a preferred embodiment, the estimated time between subsequent images is accurate to within 5 microseconds. The exposure duration can adversely effect accuracy due to the fact that optical blur associated with object motion induces error in spatial estimation. In a preferred embodiment, exposure duration is less than 75 microseconds. In a more preferred embodiment, the exposure duration is less than 30 microseconds. In a most preferred embodiment, the exposure duration is less than 10 microseconds. Exposure duration may be controlled by the strobe burn time, shutter open time, or time that the image sensor is active.

In embodiments which use a stroke it is also desirable to control the duration of the flash. Preferably, the flash duration is about 100 ms or less. More preferably, the flash duration is about 50 ms or less, and most preferably the flash duration is about 30 ms or less.

Once the images are acquired by activation of the cameras and flashes, it is desirable to calculate the kinematic properties of the ball and club to a predetermined accuracy. In one embodiment, the ball velocity is among the kinematic properties that are determined. In one embodiment, the ball velocity may be determined to within plus or minus 5 mph. In another embodiment, the ball velocity may be determined to within plus or minus 2 mph. In yet another embodiment, the ball velocity may be determined to within plus or minus 1 mph. Most preferably, the ball velocity may be determined to between plus or minus 0.5 mph.

The club velocity is another kinematic property that may be determined. In one embodiment, the club velocity may be determined to within plus or minus 5 mph. In another embodiment, the club velocity may be determined to within plus or minus 2 mph. In yet another embodiment, the club velocity may be determined to within plus or minus 1 mph. Most preferably, the club velocity may be determined to between plus or minus 0.5 mph.

In some applications, it may be desirable to determine the backspin of a ball in order to determine the trajectory. In one embodiment, the trajectory of the ball is determined to within plus or minus 500 rpm. In a preferred embodiment, the trajectory of the ball is determined to within plus or minus 200 rpm. In a most preferred embodiment, the trajectory of the ball is determined to within plus or minus 50 rpm.

Another measurement that commonly affects the trajectory is sidespin. The sidespin of the ball is preferably determined to within plus or minus 500 rpm. More preferably, the sidespin is determined to within plus or minus 250 rpm, and most preferably the sidespin is determined to within plus or minus 50 rpm.

Other characteristics of the club that may be determined are the path angle, attack angle, face angle, loft angle, and droop angle. Each of these may be determined to about 1 degree or less. More preferably, each of these may be determined to about 0.5 degrees or less, and most preferably each of these may be determined to about 0.25 degrees or less.

One aspect of the present invention that determines the accuracy of the acquired images are the camera filters. In one embodiment, the camera filters are responsible for allowing the light emitted by the fluorescent markers to pass to the camera while filtering out light of any other wavelength. This type of filter is often referred to as a monochromatic filter, and is well known to those skilled in the art. Preferably, the monochromatic filter allows light to pass that is within plus or minus 50 nm of a desired wavelength. More preferably, the monochromatic filter allows light that is within plus or minus 25 nm of a desired wavelength, and most preferably the monochromatic filter allows light to pass that is within plus or minus 5 nm of a desired wavelength.

In one embodiment, the accuracy of the present invention may be determined by using a testing apparatus, described below. FIG. 11 is a table illustrating data acquired using an exemplary launch monitor in accordance with the present invention. In one embodiment, the data is acquired by mounting a golf ball into a disk at a radial distance of, for example, 9 inches. The disk is preferably attached to a precisely controlled motor with a drive shaft. Then, a precision rotation rate sensor is attached to the drive shaft assembly to obtain true rotation rate.

In one embodiment, the rotation rate may be set to about 3000 rpm, and the launch monitor may be used to acquire a desired number of sample images, for example, 50 sample images. The images may then be analyzed to calculate kinematic characteristics including, but not limited to, ball velocity, side angle, back spin, side spin, and rifle spin.

In this embodiment, the inertia of the rotating disk and precise motor control result in a very consistent rotation rate. Therefore, assuming that the rotation rate of the assembly is constant, the standard deviations observed from the 50 sampled images may be used to quantify the repeatability of an exemplary embodiment of the present invention.

During the testing, a high intensity spot light may be used as an artificial light source to induce optical glare and illumination variations which may occur during normal outdoor use. The spotlight is preferably repositioned to several locations during the course of the 50 samples.

The table shown in FIG. 11 illustrates that the average magnitude of spin measured by the launch monitor is 3021 rpm, which is within a 3 rpm range of the rotation rate sensor of 3018 rpm. This represents accuracy, of 1 part in 1000.

The table shown in FIG. 11 also illustrates the repeatability of an exemplary embodiment of the present invention. FIG. 11 illustrates that standard deviation of speed, azimuth angle, back spin, side spin, and rifle spin were about 0.3 mph, 0.1 degrees, 10 rpm, 54 rpm, and 35 rpm respectively. This exemplary data indicates that a preferred embodiment of the present invention provides accurate and repeatable results. Using these standard deviations in ball kinematics, it is possible to estimate the uncertainty of the golf ball landing position. For a typical drive with a ball speed of 160 mph the measured kinematic variations result in a landing position uncertainty of less than 3 yards out of 260 yards.

In another exemplary embodiment, the launch monitor of the present invention may be used to collect kinematics data for a club and ball collision. In this embodiment, a GolfLabs robot is fitted with a driver, and then used to produce consistent swing characteristics. The GolfLabs robot is preferably adjusted to produce, for example, five alternative swing conditions. In this embodiment, the present invention may be used to acquire data for several impacts at each condition. FIGS. 12 and 13 are tables showing the average and standard deviations measured for each kinematic characteristic.

The standard deviations shown in FIGS. 12 and 13 are due to variations in actual club mechanics associated with the robot's swing and impact, as well as variations associated with an embodiment of the present invention. By comparing the back spin standard deviation for the consistent revolving wheel (10 rpm), shown in FIG. 12, with the back spin standard deviation reported for the robot generated ball backspin (115 rpm for Test 1), shown in FIG. 13, it can be determined that the repeatability of an embodiment of the present invention is significantly better than the robot repeatability. Therefore, one embodiment of the present invention may be used to detect small variations associated with club, ball, and robot performance.

The ball trajectory variations, shown in FIG. 13, further exemplify the repeatability and accuracy attainable with the present invention. In one embodiment, standard deviations in carry distance were about 5 yards or less and standard deviations in lateral carry deviation were 6 yards or less. As discussed earlier, the major component of these deviations may be attributed to variations in robot or club action. As demonstrated by revolving wheel tests, one embodiment of the present invention is able to measure variations less than attained on the robot.

One advantage of a launch monitor with high accuracy and repeatability is that when testing professional golfers with reproducible swings, fewer data points need to be collected to characterize performance. Typically, a professional golfer is tested using an embodiment of the present invention, only about 3-5 swings are required to accurately quantify average performance with a given club and ball combination.

Trajectory Model

The kinematic analysis is based on the acquired images and the measurements, such as spin, angle, and the like, that are determined by analyzing the images. Based on these measurements, the present invention is able to determine the trajectory of the ball. The trajectory of the ball is based on a trajectory model. In one embodiment, the trajectory model is based on aerodynamic coefficients that are obtained from an indoor test range. By using the ball, speed, launch angle, azimuth angle, backspin, side spin, and rifle spin as initial conditions, and numerically integrating the equations of motion, the present invention is able to accurately determine characteristics of the ball trajectory, using accurate aerodynamic coefficients such as distance, flight path, landing position, and final resting position.

Figure 14:
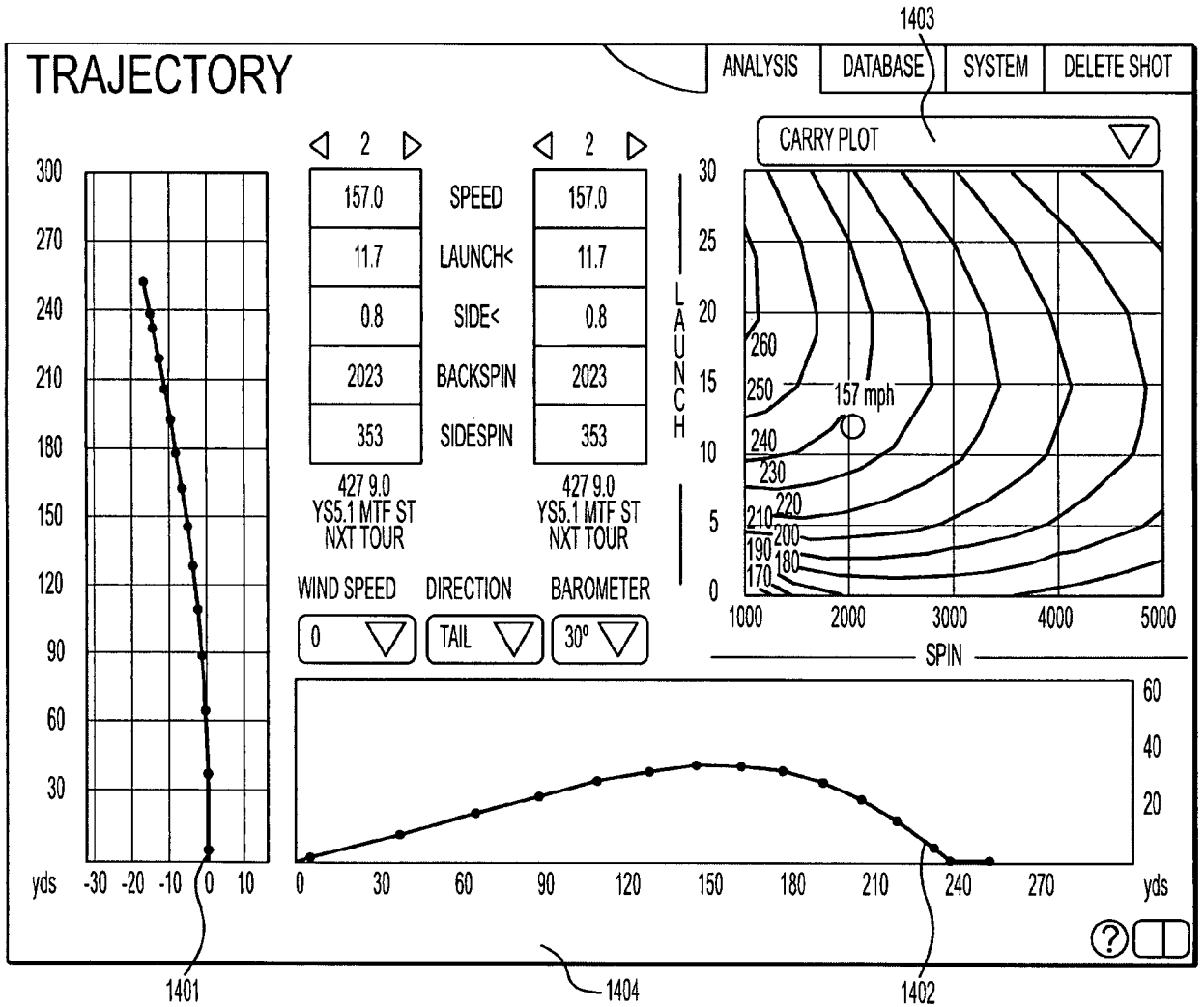
FIG. 14 is a diagram showing an exemplary screenshot that may be displayed on the user interface.

An exemplary screenshot that may be displayed on the user interface is shown in FIG. 14. In one embodiment, shown in FIG. 14, the trajectory of the ball may be represented in several manners. One such manner is shown by graph 1401, which shows the distance a ball travels as well as its horizontal displacement with respect to the tee. Another plot that may be included is shown by graph 1402. This plot shows the altitude of the ball during its trajectory. Graph 1403, which shows the launch angle and the resultant spin, may also be included.

One advantage of graphs 1401-1403 is that a player may isolate the specific aspect of the trajectory, such as lift, distance, horizontal displacement, or the like, that they would like to improve. They may then select a club, based on the kinematic analysis, that allows them to maximize this aspect of the trajectory of the ball. In addition to graphs 1401-1403, other characteristics of the ball may be shown. In some embodiments, atmospheric conditions such as the wind speed, barometer, direction of the wind, or the like, may be manipulated using drop down menu's 1404 to give a player new trajectory graphs under those altered conditions.

Battery

Each of the functional components requires power in order to function. Prior systems required each launch monitor to be attached to a power source, such as an outlet, generator, or the like. However, in one embodiment, the power source for the present invention is a battery. Using a battery as a power source enables the present invention to be portable, and free of burdensome wiring. The battery preferably allows the launch monitor to operate for a predetermined amount of time before recharging is necessary. Any battery known to those skilled in the art may be used. The battery may be chosen based on properties such as capacity, the duration that it can provide power, or chemistry.

In a preferred embodiment, the battery is capable of providing power for about two hours or greater. More preferably, the battery is capable of providing power for about four hours or greater. Most preferably, the battery is capable of providing power for about 8 hours or greater.

In other embodiments, the battery may be chosen based on its total storage capacity. Preferably, the total storage capacity of the battery is 50 watt/hrs or greater. More preferably, the total storage capacity is 250 watt/hrs or greater, and most preferably the total storage capacity is 500 watt/hrs or greater.

Many different types of batteries are currently available. These batteries are often made out of different elements. A battery's composition may be chosen based on the environment in which it will be used, its recharging ability, ability to hold charge, or the like. The batteries that may be used include, but are not limited to, Ni metal hydrides, lead acid, Lithium Ion, or the like.

In a preferred embodiment, Nickel metal hydride batteries are used. In some embodiments, it may be desirable to provide the hydride batteries with an AC power source. In such embodiments, the AC power source may either replace or supplement the battery power. This may include the ability to recharge the battery using the AC power source. Alternately, the AC power source may be the sole source of power for the present invention.

Sleep Modes

It is desirable for a battery powered device to minimize its power consumption when possible. This provides the advantage of allowing the device to function for as long as possible without being recharged. In one embodiment, the present invention is capable of switching to a "sleep mode" when it is not being used. The sleep mode allows the present invention to conserve as much power as possible, while maintaining power to perform essential functions.

In one embodiment, power is conserved in sleep mode by turning off a LCD display. In another embodiment, power consumption is reduced by at least 25% upon entering sleep mode. In a more preferred embodiment, power consumption is reduced by at least 50%, and in a most preferred embodiment power consumption is reduced by at least 75% upon entering sleep mode.

In one embodiment, the present invention enters sleep mode after a predetermined amount of time if no operator interaction is detected. Preferably, the present invention shuts down after between about 3 and 15 minutes. More preferably, the present invention shuts down after between about 5 and 10 minutes. In a preferred embodiment, the shut down time is selectable by the user and may be set within a range from 3 minutes to six hours.

In alternate embodiments, the present invention may be manually put into sleep mode via a switch, the graphic interface, or using any method or apparatus known to those skilled in the art. This may include using a sleep button on the remote or the graphic interface.

The present invention may resume normal power operations upon an outside stimulus. In one embodiment, this may include a button or switch being pressed or activated. In another embodiment, the present invention activates when the trigger, described above, detects the motion of an object. Once the motion of an object is detected, the trigger will notify the processor, which can then put the launch monitor back into a normal operating mode.

Fans

During operation, the functional components generate heat. To prevent these components from overheating, the heat is preferably removed from the inside of the housing. This allows the components to be cooled, and maintained at a tolerable operating temperature. In a preferred embodiment, the cooling is performed by at least one fan. In one embodiment, the fans are selectively operated, based on the temperature of the inside of the housing. The temperature is determined based on any temperature sensor known to those skilled in the art. When a temperature sensor detects that the temperature inside the housing exceeds a predetermined threshold, the processor activates the fans. The fans are then shut off when the temperature drops below that predetermined threshold. Having a selectively operable fan provides the advantage of conserving the battery power that is needed to power the fan. However, in embodiments where power conservation is not necessary the fans may be continuously operated.

In one embodiment, the fan preferably runs at the minimum speed necessary to stay below the desired threshold temperature. In one embodiment, each fan has a CFM rating of 10 or greater. In another embodiment, each fan has a CFM rating of 100 or greater.

Markers

The present invention may be used with any types of markers. In some embodiments, as described above, limited spectrum markers may be used. In other embodiments, high intensity markers may be used. In another embodiment, markers or features which are inherent to the object are used. Under the proper conditions, retroreflective markers and fluorescent markers can reflect more light than a white diffuse surface. This feature of retroreflective markers and fluorescent markers is useful for creating higher contrast between the illuminate markers and the remainder of the image captured by the camera. By increasing the contrast, background noise such as reflections from surfaces other than from the markers can be reduced or eliminated completely. As described below, these markers may have any desired properties, and may be placed at any desired point on the surface of an object.

In one embodiment, it is desirable to place a plurality of fluorescent markers on both the golf club and golf ball. Under proper conditions, fluorescent markers may be used to return more light within a certain spectrum or at a particular wavelength than can be reflected by a white diffuse surface. For instance, fluorescent markers can emit about 200 percent more light than a white diffuse surface when the spectrum of light includes wavelengths of light within the excitation wavelength of the fluorescent marker. The fluorescent markers of the present invention may be excited by any wavelength of light, depending on a particular application. Preferably, the fluorescent markers placed on the golf ball react to blue light (app. 460-480 nm). For example, when orange fluorescent markers are illuminated by blue light, they reflect orange light back (app. 600 nm) at a greater intensity than a white diffuse surface. Other fluorescent markers, such as green fluorescent markers, may also respond to blue light.

In this embodiment, it is desirable to differentiate between the golf club and the golf ball. Thus, it is desirable to place different fluorescent markers on the golf club and golf ball. The different fluorescent markers are preferably excited by light from the same excitation wavelengths. Bandpass filters may be used on the cameras to selectively acquire club or ball images. Alternately, color imaging sensors may be used to discriminate between club and ball markers.

In one embodiment, a plurality of markers may be placed at different points on the surface of the golf club. The different points may include the shaft, toe, heel, or sole of the club. In a preferred embodiment, the placement of the markers is chosen to facilitate optimal fingerprinting of the club. The placement of the markers may be varied in order to ensure that each club or ball is optically unique. Those skilled in the art will recognize that the placement of the markers may be varied by quantity, size, shape, and spatial location.

In a preferred embodiment, the present invention is used to measure the position and orientation of a golf ball. To aid in determining the kinematics of one or more golf balls, it is preferable to place a plurality of markers on the surface of the golf ball. The placement of the markers on the surface of the golf ball is preferably chosen to facilitate optical fingerprinting.

In other embodiments, retroreflective markers and fluorescent markers may be employed, either alone or in combination. In some embodiments, it may be preferable to distinguish between different equipment by exclusively using retroreflective or fluorescent markers on each type of equipment. In one embodiment, retroreflective markers may be used on the club while fluorescent markers may be used on the ball. In such an embodiment, retroreflective markers may be used on the golf club to allow for improved discrimination between the club markers and background light. In addition, using retroreflective markers on the club and fluorescent markers on the ball enables the cameras 2003 to permit only light from the fluorescent markers to pass. In this manner, only the ball may be imaged after impact with the club. Several examples of how different club markers and ball markers can be used to differentiate the club and ball are described in U.S. patent application Ser. No. 10/656,882, entitled "Multishutter Club-Ball Analyzer," the entirety of which is incorporated herein by reference.

In another embodiment, the manufacturers logo or stamping may be used for optical fingerprinting. The markers placed on the surface of the club or golf ball 105 may have a substantially circular shape. Preferably, each of the circular markers has a radius of between 0.10 and 5 mm. More preferably, each of the markers has a radius of between 0.50 and 3 mm, and most preferably each of the markers has a radius of between 0.75 and 2.5 mm.

The present invention is not intended to be limited to substantially circular markers. In other embodiments, the shape of each marker may be changed as desired. For example, at least one marker may have a geometric shape other than a circular one, such as a triangular, rectangular or square shape. Additionally, at least one marker may be a line or may have the shape of a symbol, such as a plus sign, an alphanumeric character such as a "T" or an "O", a star, an asterisk, or the like. Alternately, at least one marker may be part of a decorative logo that is placed on the ball or club.

The markers may be placed on the club or ball based on any known method or apparatus. In one embodiment, the markers are pad printed onto the golf ball. This provides the advantage of reducing the effect of the markers on the trajectory of the ball. However, in other embodiments, the markers may be painted, glued, or otherwise attached to the surface of the golf club or ball.

Accessories

The present invention is capable of storing a plurality of accessories within the housing, as described above. Any number or type of accessories may be used with the present invention. Such accessories may be used to supplement the functions that are described above. For example, a video camera may be stored and subsequently used in accordance with the present invention. The acquired video may be stored in a memory, and then played back via the integrated display. This video may be used for additional analysis, such as biomechanical swing analysis. Other accessories, such as adhesive markers, may also be stored within the housing of the present invention.

Compliance

The present invention includes a plurality of functional components, as described above. Substantially all of the functional components include at least some electrical components. When dealing with electrical components, it is often desirable to ensure that they comply with well known safety standards. The functional components of the present invention substantially comply with United States and International safety standards.

In one embodiment, the present invention complies with part 15 of the Federal Communications Commission rules for radiated emissions. The present invention also complies with safety requirements of Underwriters Laboratory and CE, the European equivalent to Underwriters Laboratory.

Analysis

The present invention is capable of performing many different types of kinematic analysis. The kinematic analysis is preferably performed on the golf club and the golf ball, and may be used to compare a player's performance when using different types of equipment. The kinematic analysis of the ball may include, but is not limited to, speed, launch angle/azimuth, spin rates, carry distance/dispersion, and total distance/dispersion.

Figure 15:
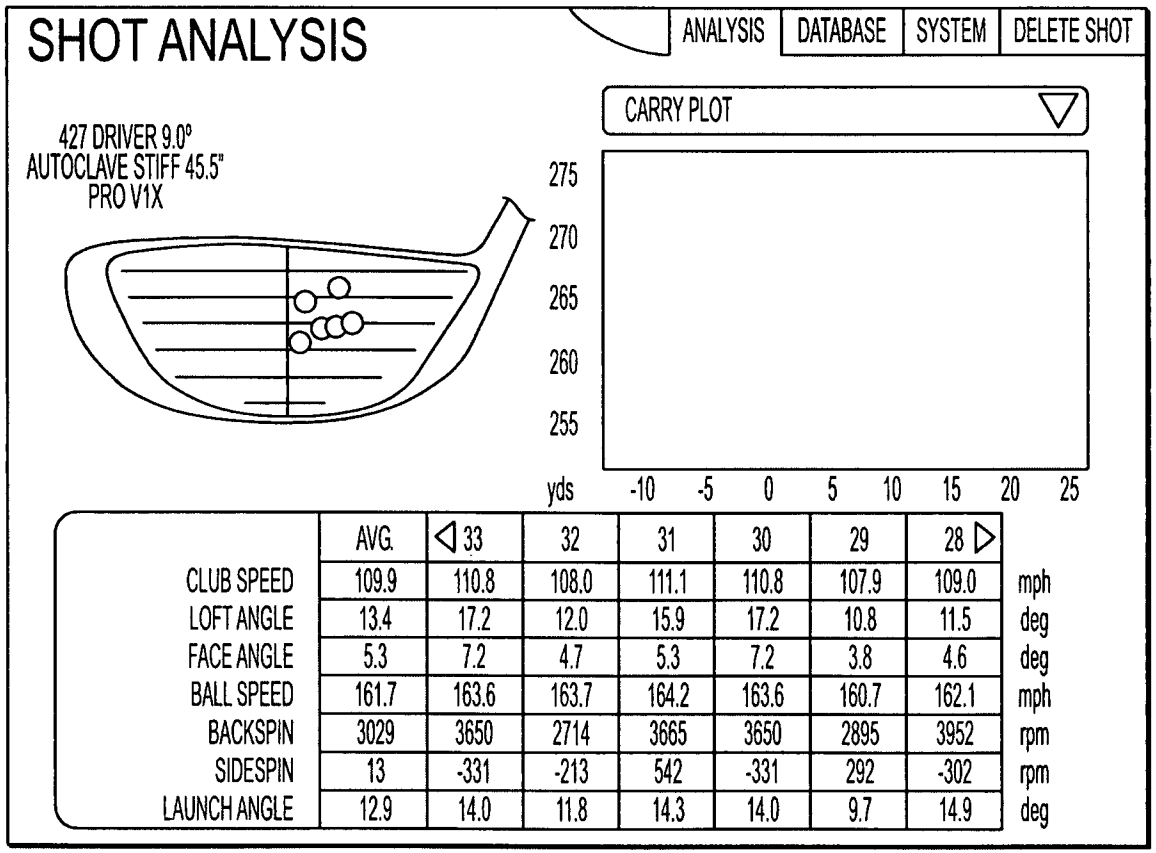
Figure 16:
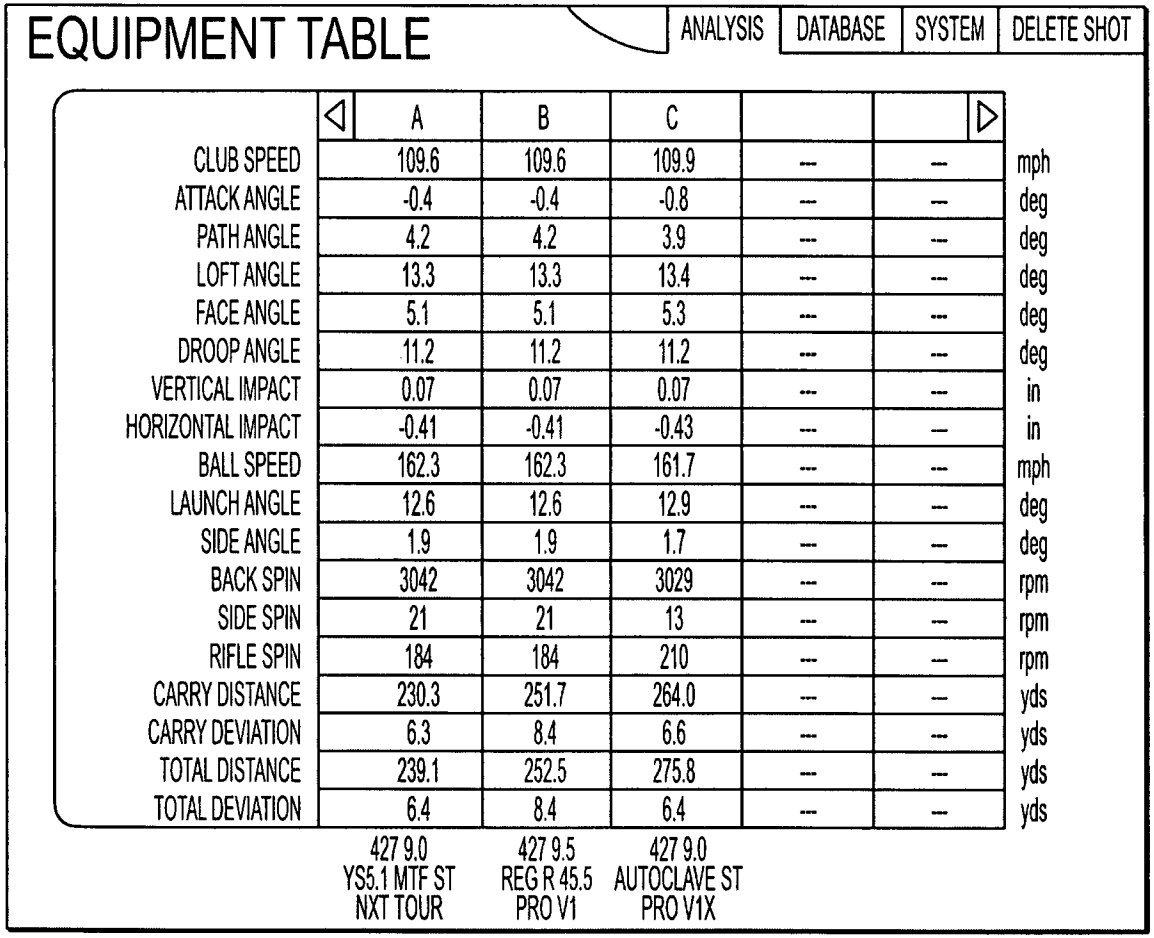

A player's swing requires many aspects to be mastered in order to achieve an optimal ball trajectory. The mechanics of a swing may be broken down into many aspects, all of which must be performed properly in order to become a good player. Thus, one embodiment of the present invention, as shown in FIGS. 15-17, performs a kinematic analysis of the club so that a player may determine how to improve their swing. The kinematic analysis may include, but is not limited to, face spin rate, droop spin rate, loft spin rate, face angle, droop angle, loft angle, vertical/horizontal impact position, attack angle, path angle, and club speed.

In the FIG. 15 embodiment, a graphical analysis is shown for a plurality of shots taken with the same club. The graphical analysis shown in FIG. 15 allows a user to see where each shot hit the face of the club, a carry plot showing the distance a ball traveled and its horizontal displacement from the point at which it was struck, and a table showing a numerical analysis for each shot. In another embodiment, the kinematic analysis for each shot may only be shown numerically, as shown in FIG. 17.

In one embodiment, the kinematic analysis may also be shown according to different types of clubs that are used. In one exemplary embodiment, shown in FIG. 16, the analysis is shown for each club that is used. The FIG. 16 embodiment allows a user to compare the effect of each club on each aspect of the trajectory of the club and that ball. A user may desire this type of analysis to determine, for example, the club which best suits their style of play.

After performing the kinematic analysis for both the club and the ball, the analysis is processed. In one embodiment, this processing includes comparing the analysis of each type of club or ball. This type of analysis may be useful to a player because it allows them to determine which equipment allows them to achieve an optimal ball trajectory. Many different types of analysis may be performed. The type of analysis may depend on a particular player. This analysis may include, but is not limited to, an analysis of the same ball with different clubs, the same club with different balls, the same ball or club and multiple swings, or the backspin versus launch angle. The trajectory may also be analyzed. Such analysis may include, but is not limited to, the trajectory versus club speed, trajectory versus loft angle, trajectory versus ball speed, trajectory versus face angle, trajectory versus launch angle and the trajectory versus sidespin.

The analysis may displayed on a variety of devices. In one embodiment, the analysis may be transmitted, via the wireless connection described above, to a computer or central database. The data may then be analyzed by the computer or central database and then viewed. Alternately, the data may be analyzed by the processor and then transmitted to the computer or central database.

In a preferred embodiment, the data and analysis is displayed on the user interface. This allows a player to view the data and analysis right after they hit a ball. In this preferred embodiment, the user interface is capable of displaying photorealistic club images. Other visual displays including, but not limited to, the display of the product used, the ball impact location, path of attack, and club angles may also be displayed.

Figure 18:
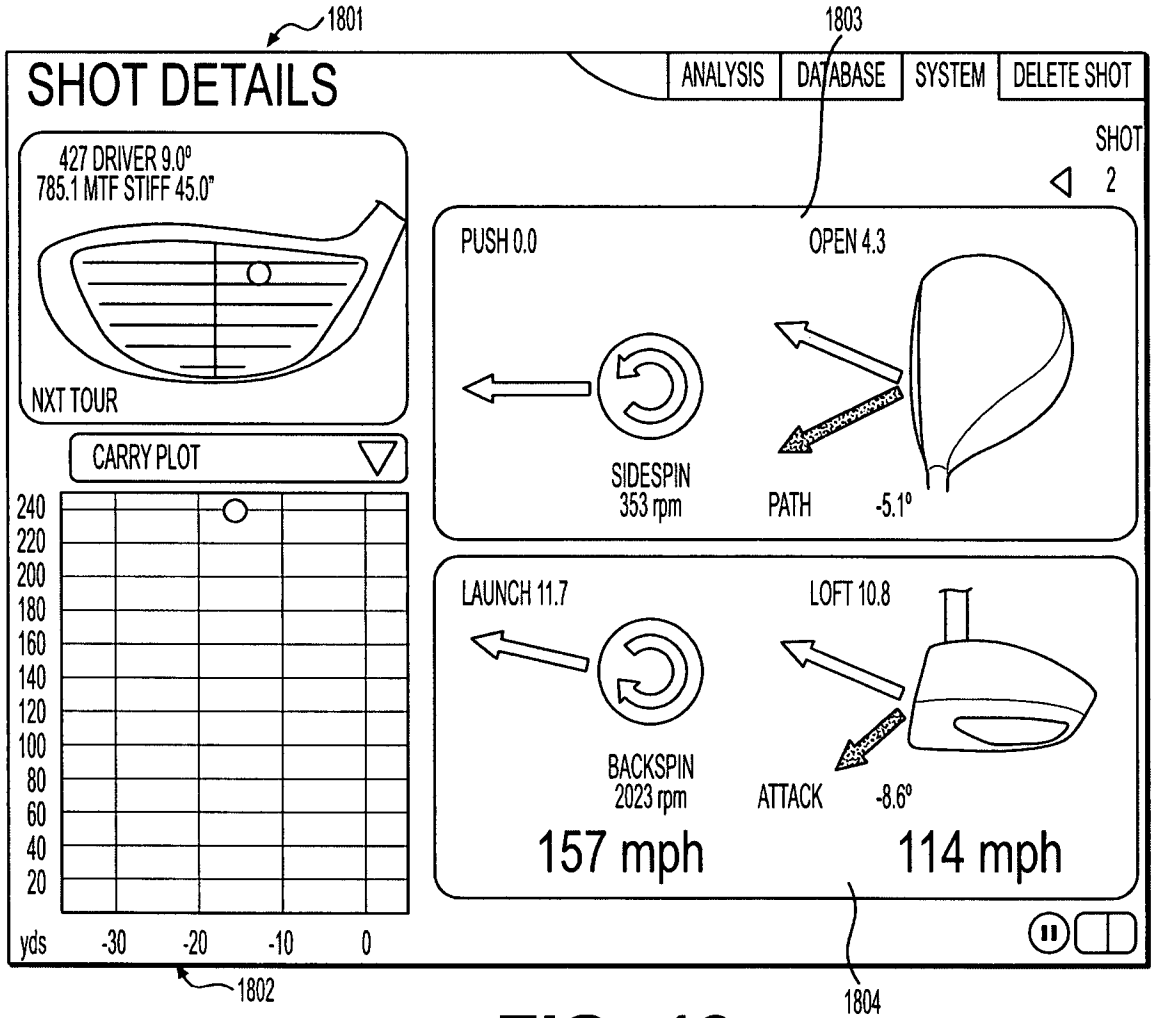
FIG. 18 is a diagram showing one exemplary type of kinematic analysis that may be performed according to an exemplary embodiment of the present invention.
Figure 19:
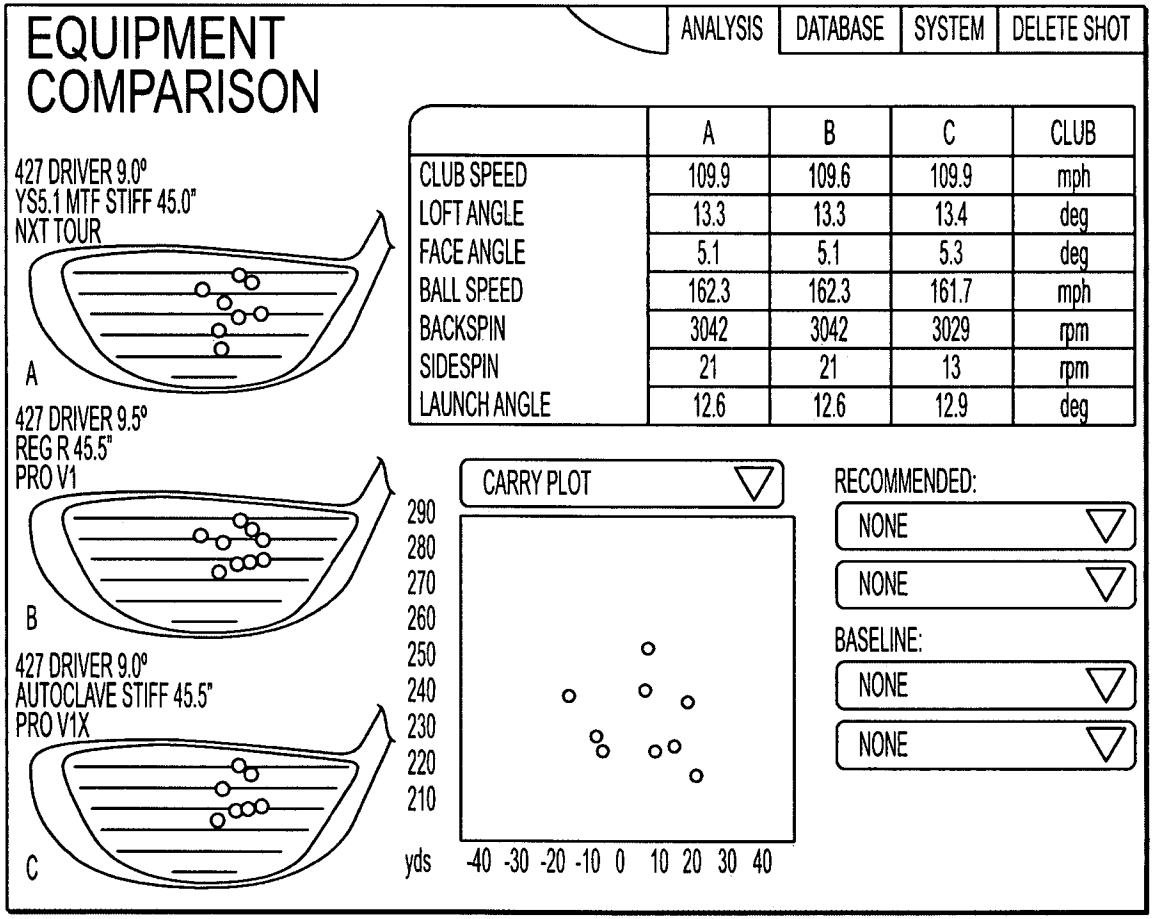
FIG. 19 is a diagram showing the kinematic analysis of three different clubs displayed on an exemplary user interface.

FIGS. 18 and 19 are diagrams showing exemplary screenshots that can be displayed on the user interface. FIG. 18 shows one exemplary type of kinematic analysis that may be performed according to an exemplary embodiment of the present invention. The FIG. 18 diagram shows four types of analysis that may be performed. First, part 1801 of the diagram shows a picture of the face of the club, as well as where the ball struck the face of the club. Part 1802 of the diagram shows a carry plot, which shows a player how far the ball will fly. The carry plot may be determined by a variety of factors, such as backspin, sidespin, attack angle, and the like.

In the FIG. 18 embodiment, part 1803 and 1804 show a top and front view of the head of the club, respectively. Each view provides an analysis of the path of the club head, such as loft angle, attack angle, and the like. Additionally, the resultant spin on the ball, and the velocity of both the club and ball may be displayed, as shown in FIG. 18.

In another embodiment, shown in FIG. 19, the kinematic analysis of three different clubs may be displayed on an exemplary user interface. In this embodiment, a color coded carry plot may be used. The color coded carry plot may show the distance the ball went, as well as its horizontal displacement with respect to the tee. In addition, a comparison of the kinematic analysis for each club may be displayed. This display may be used to aid a player in any manner, including, but not limited to, determining which club results in the best trajectory of a golf ball.

Although the present invention has been described with reference to particular embodiments, it will be understood to those skilled in the art that the invention is capable of a variety of alternative embodiments within the spirit of the appended claims.

The invention claimed is:

1. An apparatus for determining golf club and golf ball kinematics, comprising:

a RFID reader operatively connected to a housing;

a golf club including a RFID tag wherein the RFID reader is capable of communicating with the RFID tag to automatically identify the golf club; and a camera configured to acquire an image of the golf club in motion in order to determine the kinematic characteristics of the golf club;

a processor configured to provide a comparison of the kinematic characteristics of at least two golf clubs in motion, wherein the comparison includes at least two properties of each of the at least two golf clubs.

2. The apparatus according to claim 1, wherein the RFID reader is capable of communicating with the RFID tag within about 2 feet or greater.

3. The apparatus according to claim 1, wherein the RFID reader is capable of communicating with the RFID tag within about 4 feet or greater.

4. The apparatus according to claim 1, wherein the RFID reader is capable of communicating with the RFID tag within about 6 feet or greater.

5. The apparatus according to claim 1, wherein the RFID tag is embedded in the golf club during the golf club manufacturing process.

6. The apparatus according to claim 1, wherein the RFID tag is selectively positioned within a non-conducting portion of the golf club.

7. The apparatus according to claim 1, wherein the RFID tag comprises a passive RFID tag.

8. The apparatus according to claim 1, wherein the RFID tag is included within one of the undersurface on the grip end of the golf club, the head of the golf club, the shaft, the golf grip, and between the grip and golf shaft.

9. The apparatus according to claim 1, further comprising a golf ball including an RFID tag.

10. The apparatus according to claim 9, wherein the RFID tag is embedded in the golf ball during the golf ball manufacturing process.

11. The apparatus according to claim 9, wherein the RFID reader is capable of communicating with the RFID tag to automatically identify the golf ball.

12. The apparatus according to claim 9, wherein the RFID reader is capable of communicating with the RFID tag to deter mine when the golf ball is in motion.

13. The apparatus according to claim 1, wherein the RFID reader identifies the golf club based on a unique identifier transmitted from the RFID tag.

14. A method for determining the kinematics of a golf object, comprising the steps of:

a) storing unique identifiers in a computer system for a plurality of golf objects;

b) communicating with a RFID tag included with a first golf object;

c) receiving a unique identifier from the RFID tag;

d) automatically identifying the golf object based on the received unique identifier;

e) acquiring an image of the golf object in motion in order to determine the kinematic characteristics of the golf object;

f) repeating steps a) through e) with a second golf object; and g) providing a comparison of the kinematic characteristics of the first and second golf objects, wherein the comparison includes at least two properties of each of the first and second golf objects.

15. The method according to claim 14, wherein the rate of automatically identifying is about three seconds or less.

16. The method according to claim 14, wherein the rate of automatically identifying is about one second or less.

17. The method according to claim 14, wherein the stored unique identifiers comprises unique identifiers for about 50 or more golf objects.

18. The method according to claim 14, wherein the stored unique identifiers comprise unique identifiers for about 100 or more golf objects.

19. The method according to claim 14, wherein the stored unique identifiers comprise unique identifiers for about 500 or more golf objects.

20. The method according to claim 14, wherein the stored unique identifiers comprise unique identifiers for about 1000 or more golf objects.

21. The method according to claim 14, wherein the golf objects comprise one of a golf club, a golf ball, golf bags, golf shoes, golf ball boxes, and golf ball pallets.

22. The method according to claim 14, wherein the unique identifier comprises a serial number.

23. The method according to claim 14, wherein the automatically identifying comprises automatically identifying a golf club and golf ball substantially simultaneously.

24. A method for determining the kinematics of one or more golf objects, comprising the steps of:

a) including a RFID tag with a golf ball;

b) transmitting information between the RFID tag and a RFID reader;

c) determining when the golf ball is in motion based on the information transmitted between the RFID tag and the RFID reader;

d) providing at least one trigger operable to trigger a camera to acquire images of the golf ball when the golf ball is in motion;

e) determining the kinematic characteristics of the golf ball based on the acquired images;

f) repeating steps a) through e) with at least two golf balls; and g) providing a comparison of the kinematic characteristics of each golf ball, wherein the comparison includes at least two properties of each golf ball.

25. The method according to claim 24, wherein the transmitting comprises automatically identifying the golf ball.

26. The method according to claim 25, wherein the rate of the automatically identifying is about 3 seconds or less.

27. The method according to claim 25, wherein the rate of automatically identifying is about 1 second or less.

28. The method according to claim 24, wherein the determining is based on the strength of the signal transmitted from the RFID tag to the RFID reader.

29. The method according to claim 24, wherein the RFID reader and the RFID tag are capable of communicating at a distance of about 2 feet or greater.

30. The method according to claim 24, wherein the RFID reader and the RFID tag are capable of communicating at a distance of about 4 feet or greater.

31. The method according to claim 24, wherein the RFID reader and the RFID tag are capable of communicating at a distance of about 6 feet or greater.

32. The method according to claim 25, wherein the automatically identifying is based on a unique identifier.

33. The method according to claim 28, further comprising:

transmitting a signal between the RFID tag and the RFID reader at predetermined intervals; and determining when the golf ball is in motion based on a change in the strength of the transmitted signal.

34. The method according to claim 33, wherein the predetermined interval is about 10 microseconds or less.

35. The method according to claim 33, wherein the predetermined interval is about 5 microseconds or less.

36. The method according to claim 33, wherein the predetermined interval is about 1 microsecond or less.

37. A method for determining the kinematics of one or more golf objects, comprising the steps of:

a) including a RFID tag with a golf object;

b) transmitting information between the RFID tag and a RFID reader;

c) determining when the golf object is in motion based on the information transmitted between the RFID tag and the RFID reader;

d) providing at least one trigger operable to trigger a camera to acquire images of the golf object in motion;

e) determining the kinematic characteristics of the golf object based on the acquired images;

f) repeating steps a) through e) with at least two golf objects; and g) associating at least two properties of each of the two golf objects with the kinematic characteristics of each golf object;

h) providing a recommendation of which of the at least two golf objects provides a desired trajectory, wherein the desired trajectory is based on comparison of at least two properties of each golf object and the kinematic characteristics of each golf object.

* * * * *